US007613605B2

(12) United States Patent
Funakoshi

(10) Patent No.: US 7,613,605 B2
(45) Date of Patent: Nov. 3, 2009

(54) AUDIO SIGNAL ENCODING APPARATUS AND METHOD

(75) Inventor: Masanobu Funakoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 376 days.

(21) Appl. No.: 11/749,563

(22) Filed: May 16, 2007

(65) Prior Publication Data

US 2007/0265836 A1 Nov. 15, 2007

Related U.S. Application Data

(63) Continuation of application No. PCT/JP2005/021014, filed on Nov. 16, 2005.

(30) Foreign Application Priority Data

Nov. 18, 2004 (JP) ..... 2004-335005
Nov. 14, 2005 (JP) ..... 2005-328945

(51) Int. Cl.
*G10L 19/00* (2006.01)

(52) U.S. Cl. ..... 704/219; 704/222; 704/229; 375/240.22

(58) Field of Classification Search ..... 704/219, 704/222, 229; 375/240.22
See application file for complete search history.

(56) References Cited

U.S. PATENT DOCUMENTS 5,495,552 A 2/1996 Sugiyama et al.
6,301,558 B1 10/2001 Isozaki
7,539,612 B2 * 5/2009 Thumpudi et al. ..... 704/200.1
2005/0114126 A1 * 5/2005 Geiger et al. ..... 704/230
2006/0241942 A1 * 10/2006 Chen et al. ..... 704/230

FOREIGN PATENT DOCUMENTS

JP 06-252773 9/1994

(Continued)

OTHER PUBLICATIONS

The Written Standard of MPEG-1 Audio Layer III (ISO/IEC 1172-73, "Coding of Moving Pictures and Associated Audio for Digital Storage Media at up to About 1.5 MBIT/s" (1993/Cor. 1:1996(E)).
The Written Standard of MPEG-2 AAC (ISO/IEC 13818-7, "Information technology—Generic coding of moving pictures and associated audio information", pp. i-vi and 1-7 (2006)).
Dueñas et al., Audio Engineering Society Convention Paper, "A Robust and Efficient Implementation of MPEG-2/4 AAC Natural Audio Coders", 112$^{th}$ Convention, pp. 1-6 (2002).

(Continued)

*Primary Examiner*—Daniel D Abebe
(74) *Attorney, Agent, or Firm*—Fitzpatrick, Cella, Harper & Scinto

(57) ABSTRACT

An audio signal encoding apparatus includes a frame dividing unit (1), an auditory psychological arithmetic unit (2), a filter bank unit (3), a scale factor calculation unit (4) which weights the spectra in the respective frequency bands by an arithmetic result of the auditory psychological arithmetic unit (2), a quantization step determination unit (7) which determines a quantization step of the entire frame prior to spectrum quantization by subtracting an information size of all quantized spectra from an auditory information size of all the weighted spectra before quantization, and multiplying the difference by a coefficient obtained from a step width of a quantization coarseness, a spectrum quantization unit (8), and a bit shaping unit (9) which outputs a bitstream obtained by shaping quantized spectra. The quantization step determination unit predicts the information size of all the quantized spectra based on a bit size assigned to a frame to be encoded.

16 Claims, 18 Drawing Sheets

FOREIGN PATENT DOCUMENTS

| | | |
|---|---|---|
| JP | 06-259099 | 9/1994 |
| JP | 08-237131 | 9/1996 |
| JP | 10-233692 | 9/1998 |
| JP | 2001-184091 | 7/2001 |
| JP | 2001-242895 | 9/2001 |
| JP | 2002-182695 | 6/2002 |
| JP | 2003-271199 | 9/2003 |

OTHER PUBLICATIONS

PCT/JP2005/021014, Corrected translation of International Preliminary Report on Patentability.

* cited by examiner

AUDIO SIGNAL ENCODING APPARATUS AND METHOD

This application is a continuation of copending international patent application number PCT/JP2005/021014 filed Nov. 16, 2005

TECHNICAL FIELD

The present invention relates to an audio signal encoding apparatus and method.

BACKGROUND ART

In recent years, high-sound quality, high-efficiency audio signal encoding techniques are popularly used in audio tracks of DVD-Video, portable audio players, music delivery, music storage in a home server of a home LAN, and the like, and have prevailed, gaining significant importance.

Most of such audio signal encoding techniques execute a time-frequency transform by exploiting transform coding techniques. For example, MPEG-2 AAC, Dolby Digital (AC-3), and the like form a filter bank by orthogonal transform alone such as MDCT (Modified Discrete Cosine Transform) or the like. Also, MPEG-1 Audio Layer III (MP3) and ATRAC (an encoding scheme used in an MD (MiniDisc)) form a filter bank by using a cascade of a subband filter such as QMF (Quadrature Mirror Filter) and an orthogonal transform.

These transform coding techniques make masking analysis by exploiting a perceptual property of human. By removing spectrum components which are determined to be masked or allowing masked quantization errors, an information amount for spectral expression is reduced, thus enhancing the compression efficiency.

These transform coding techniques compress an information amount of a spectrum by nonlinearly quantizing spectrum components. For example, MP3 and AAC compress the information amount by raising respective spectrum components to the power of 0.75.

These transform coding techniques combine input signals transformed into frequency components by the filter bank for respective decomposed frequency bands set based on the frequency resolution of the human auditory sensitivity. Then, an information amount is reduced by determining normalization coefficients for respective decomposed frequency bands based on auditory analysis result upon quantization, and expressing frequency components by combinations of the normalization coefficients and quantized spectrum. This normalization coefficient is a variable used to adjust a quantization coarseness for each decomposed band in practice. When the normalization coefficient changes by 1, the quantization coarseness changes by one step. MPEG-2 AAC calls this decomposed frequency band a scale factor band (SFB), and calls the normalization coefficient a scale factor.

These transform coding schemes control the code amount by controlling the quantization coarseness of one entire frame as an encoding unit. In many transform coding schemes, the quantization coarseness is controlled stepwise with a width of a given radix raised to the power of an integer, and this integer is called a quantization step. In the MPEG audio standard, a quantization step that sets the quantization coarseness of the entire frame is called "global gain" or "common scale factor". Also, by expressing the aforementioned scale factor as a relative value to the quantization step, an information amount required for the codes of these variables is reduced.

For example, in MP3 and AAC, when these variables change by 1, the actual quantization coarseness changes by 2 raised to the power of 3/16.

In the quantization processing of the transform coding scheme, the scale factor is controlled to control quantization distortion, so as to mask quantization errors by reflecting the result of auditory arithmetic operations. At the same time, the code amount of the entire frame must be controlled to control the quantization step so as to adjust the quantization coarseness of the entire frame as needed. Since these two different types of numerical values that determine the quantization coarseness exert an important influence on encoding quality, these two different control processes are required to be carefully and accurately done at the same time and with high efficiency.

The written standards (ISO/IEC 11172-3) of MPEG-1 Audio Layer III (MP3) and those (ISO/IEC 13818-7) of MPEG-2 AAC announce a method of executing repetitive processing by means of double loops including a distortion control loop (outer loop) and code amount control loop (inner loop) as a method of controlling the scale factor and global gain upon quantization as needed. This method will be described below with reference to the drawings. Note that the following description will be given taking the case of MPEG-2 AAC as an example for the sake of convenience.

FIG. 19 is a simple flowchart of quantization processing described in the ISO/IEC written standards.

In step S501, the scale factors and global gain of all SFBs are initialized to zero and the process enters a distortion control loop (outer loop).

In the distortion control loop, a code amount control loop (inner loop) is executed first.

In the code amount control loop, in step S502 1024 spectrum components for one frame are quantized according to the following quantization equation:

$$X_q = Int\left[\left[|x_i| \cdot 2^{-1/4\cdot(\text{global_gain-}scalefac)}\right]^{3/4} + 0.4054\right] \quad (1)$$

where $X_q$ is the quantized spectrum, $x_i$ is the spectrum (MDCT coefficient) before quantization, global_gain is the global gain, and scalefac is the scale factor of the SFB that includes this spectrum component.

Next, the number of use bits for one frame upon Huffman-encoding these quantized spectrum is calculated in step S503, and is compared with the number of bits assigned to the frame in step S504. If the number of use bits is larger than the number of assigned bits, the global gain is incremented by 1 to make the quantization coarser in step S505, and the process returns to the spectrum quantization in step S502. This repetition is made until the number of required bits after quantization becomes smaller than the number of assigned bits, and the global gain is determined at that time, thus ending the code amount control loop.

In step S506, the spectrum quantized by the code amount control loop is dequantized and the difference between the dequantized spectrum and that before quantization is calculated to obtain quantization errors. The quantization errors are combined for each SFB.

It is checked in step S507 if the scale factor >0 in all the SFBs or the quantization errors fall within an allowable error range. If an SFB that does not meet these conditions is found, the process advances to step S508 to increment by 1 the scale factor of the SFB whose quantization errors do not fall within the allowable error range, and the distortion control loop processing is repeated again. Note that allowable errors for each SFB are calculated by auditory arithmetic operations before the quantization processing.

As described above, the quantization processing method described in the ISO written standards is configured by double loops, and the global gain and scale factor undergo only control with a step width of 1. For this reason, the spectrum quantization and bit calculations are repeated endlessly until this processing converges.

In case of, e.g., MPEG-2 AAC, the spectrum quantization makes calculations of equation (1) 1024 times for each processing. Since there are 11 different Huffman code tables to be searched upon bit calculations, if the Huffman code tables are fully searched, the calculation amount of the bit calculations inevitably becomes large.

Furthermore, in the distortion control loop, the quantization errors are calculated after inverse quantization, and this processing also requires high computational complexity. For this reason, a huge computational complexity is required until the double loops converge.

In order to solve this problem, various attempts have been made to reduce the computational complexity by reducing the number of repetition times of the double loops.

For example, Japanese Patent Laid-Open No. 2003-271199 discloses a technique that controls the common scale factor and scale factor not with a step width of 1 but of 2 or more determined by the number of steps according to the characteristics of the Huffman code tables. In this way, the numbers of loop times of the double loops are reduced to reduce the computational complexity.

Japanese Patent Laid-Open No. 2001-184091 discloses a method of executing a normal inner loop after an estimated value of the quantization step is calculated first, and the scale factor is then calculated according to MNR.

Also, A. D. Duenes, R. Perez, B. Rivas, et. al., "A robust and efficient implementation of MPEG-2/4 AAC Natural Audio Coders", AES 112th Convention Paper (2002) discloses a technique that calculates the scale factor as needed prior to the spectrum quantization using an equation obtained by modifying equation (1) and allowable error energy for each SFB obtained by auditory analysis. In this way, the outer distortion control loop of the double loops is removed to reduce the computational load.

Using these conventional techniques, convergence of the double loops of the quantization processing can be accelerated to reduce the computational complexity of the quantization processing to some extent.

DISCLOSURE OF INVENTION

Problems That the Invention is to Solve

However, the conventional art cannot fully avoid repetitions of the double loops described in the ISO written standards. For this reason, the quantization processing cannot be completed unless the spectrum quantization is repeated several to several tens of times, and the computational complexity of the quantization processing that occupies in the entire encoding processing is still large.

Especially, of the double loops, the outer distortion control loop can be removed by calculating the scale factor in advance using the auditory arithmetic operation result. However, it is impossible for the prior art to calculate the quantization step before quantization.

For this reason, the prior art repetitively executes the spectrum quantization and bit calculations, thus wasting the computational power.

As processing that requires high computational complexity as well as the quantization processing, psychoacoustic analysis is known. When a reduction of the computational complexity has priority over encoding efficiency and, more particularly, when, for example, a reduction of consumption power has priority over sound quality in a relatively inexpensive portable video capturing device or the like, encoding can be done without any psychoacoustic analysis. At this time, in the quantization processing, scale factors are uniformly set to be the same value in all the decomposed frequency bands, thus removing the outer distortion control loop and reducing the computational complexity.

The aforementioned problem is similarly posed in the configuration that does not perform any psychoacoustic analysis. Even when the scale factors are uniformly set to be the same value in all the decomposed frequency bands, only the outer distortion control loop can be omitted, and it is impossible for the prior art to calculate the quantization step before quantization. For this reason, in the conventional art, the spectrum quantization and bit calculations are repeatedly carried out in the code amount control loop, thus wasting the computational power.

Furthermore, since the configuration that does not perform any psychoacoustic analysis does not calculate any PE (perceptual entropy) as a basis for the code amount control, reserved bits reserved in a bit reservoir cannot be assigned to a frame, thus further deteriorating the sound quality.

It is, therefore, an object of the present invention to reduce the computational complexity required for the quantization processing in audio signal encoding.

It is another object of the present invention to reduce the computational complexity required for quantization while minimizing deterioration of sound quality due to non-execution of psychoacoustic analysis in audio encoding configured not to execute any psychoacoustic analysis.

Means of Solving the Problems

An audio signal encoding apparatus according to one aspect of the present invention includes: a frame dividing unit configured to divide an audio input signal into processing unit frames for respective channels; a psychoacoustic arithmetic unit configured to analyze the audio input signal to determine a transform block length and to make an auditory masking calculation; a filter bank unit configured to decompose a frame to be processed into blocks in accordance with the transform block length determined by the psychoacoustic arithmetic unit to transform time domain signals in the frame into one or more sets of frequency spectrum; a scale factor calculation unit configured to divide the frequency spectrum output from the filter bank unit into a plurality of frequency bands, and weight the spectrum in the respective frequency bands by an arithmetic result of the psychoacoustic arithmetic unit; a quantization step determination unit configured to determine a quantization step of the entire frame prior to spectrum quantization by subtracting an information amount of all quantized spectrum from an perceptual information amount of all the spectrum before quantization, which are weighted by the scale factor calculation unit, and multiplying the difference by a coefficient obtained from a step width of a quantization coarseness; a spectrum quantization unit configured to quantize the frequency spectrum sequence using the scale factors and the quantization step; and a bit shaping unit configured to form and output a bitstream obtained by shaping quantized spectrum output from the spectrum quantization unit in accordance with a predetermined format, wherein the quantization step determination unit includes a quantized spectral information amount prediction unit configured to predict the information amount of all the quantized spectrum based on a bit size assigned to a frame to be encoded.

An audio signal encoding apparatus according to another aspect of the present invention includes: a frame dividing unit configured to divide an audio input signal into processing unit frames for respective channels; a filter bank unit configured to execute processing for transforming time domain signals for two successive frames obtained from the frame dividing unit into frequency spectrum while shifting frame by frame; a spectral information amount calculation unit configured to calculate an information amount of the frequency spectrum output from the filter bank unit as a spectral information amount before quantization; a quantized spectral information amount prediction unit configured to predict a quantized spectral information amount based on a frame average bit size calculated from a bit rate and a sampling rate; a quantization step determination unit configured to determine a quantization step for the entire frame prior to spectrum quantization by subtracting the quantized spectral information amount predicted by the quantized spectral information amount prediction unit from the spectral information amount before quantization calculated by the spectral information amount calculation unit, and multiplying the difference by a coefficient obtained from a step width of a quantization coarseness; a spectrum quantization unit configured to quantize the frequency spectrum using the quantization step determined by the quantization step determination unit; a bit reservoir configured to manage a reserved bit size complying with an encoding standard to match the standard; a bit shaping unit configured to generate a bitstream by shaping the frequency spectrum quantized by the spectrum quantization unit in accordance with a predetermined format; and a spectrum assigned bits calculation unit configured to calculate a spectrum assigned bit size by partially adding the reserved bit size reserved in the bit reservoir to the frame average bit size, wherein the spectrum quantization unit performs code amount control based on the spectrum assigned bit size calculated by the spectrum assigned bits calculation unit.

Further features and advantages of the present invention will become apparent from the following description of exemplary embodiments with reference to the attached drawings.

BEST MODE FOR CARRYING OUT THE INVENTION

Basically, the present invention aims at calculating a quantization step before actual quantization based on the concept that the overall quantization coarseness can be calculated by dividing an information amount before quantization by that after quantization. Note that the quantization coarseness is generally given by a radix raised to the power of the quantization step. Hence, by taking a logarithm which has this radix as a base so as to calculate the quantization step, division of the information amounts to calculating the difference between the information amounts. When this difference is multiplied by a coefficient determined by a step width of quantization, an accurate quantization step can be calculated. Furthermore, the information amount after actual quantization can only be obtained after quantization. However, since the information amount after actual quantization can be predicted from a code amount assigned to a frame, the present invention calculates an accurate quantization step before quantization by exploiting this prediction.

Also, the present invention uses a frame average code amount upon prediction before quantization. Upon actual quantization, the present invention adds some reserved bits reserved in a bit reservoir to the frame average code amount, and controls a code amount with reference to that sum. In this manner, even when slight errors have occurred in the predicted value of the quantization step, the quantization processing is completed by single spectrum quantization. In addition, some reserved bits are automatically assigned to a frame with a large information amount without any auditory analysis.

According to the present invention, since the scale factor is calculated and settled first, and a quantization step can then be almost accurately calculated by a calculation using that value, quantization can be completed by nearly the single spectrum quantization and bit calculation.

Preferred embodiments of the present invention will be described in detail in accordance with the accompanying drawings. The present invention is not limited by the disclosure of the embodiments and merely shows specific examples effective to practice the present invention. All combinations of the features described in the embodiments are not always indispensable to solving means of the present invention.

First Embodiment

Figure 1:
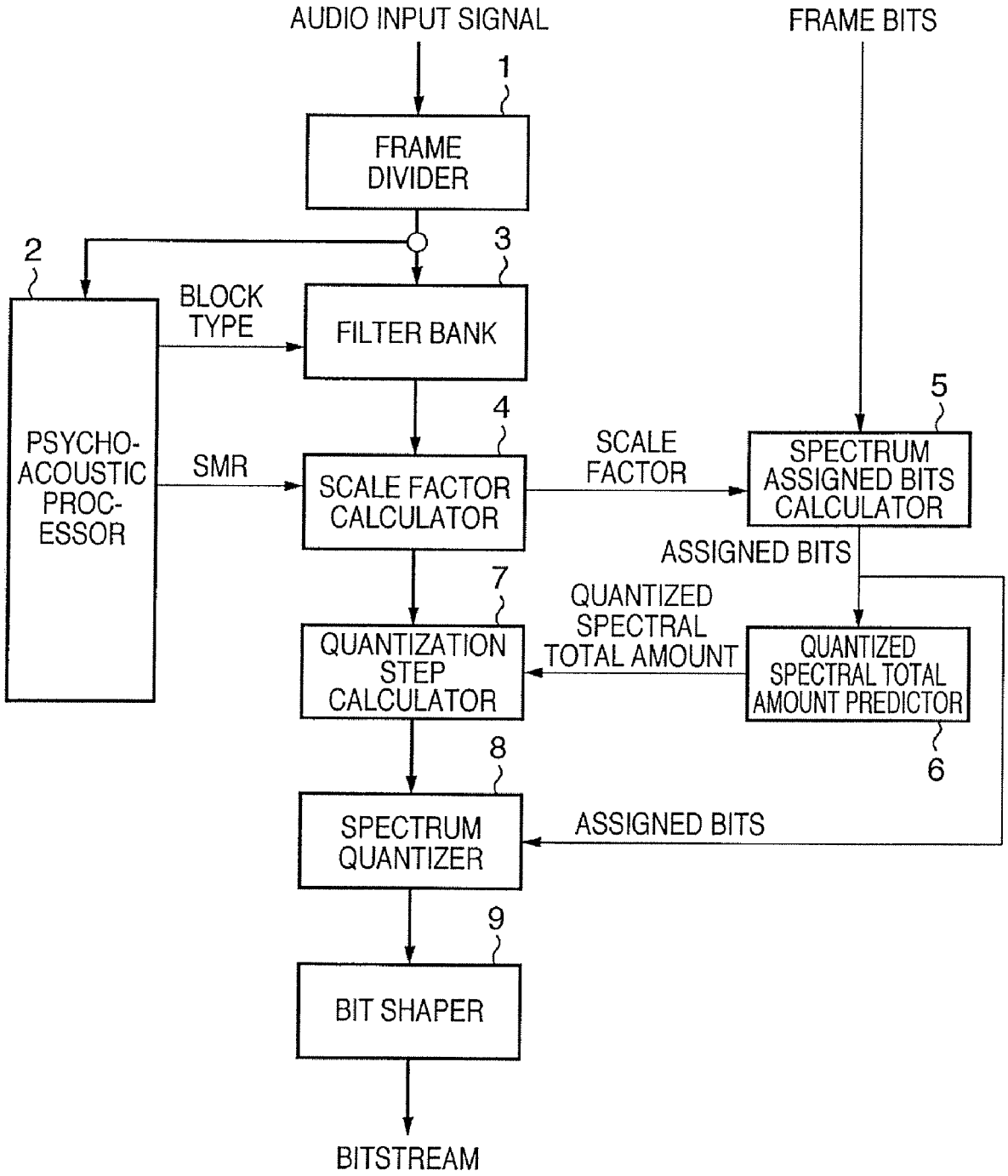
FIG. 1 is a block diagram showing an example of the arrangement of an audio signal encoding apparatus according to the first embodiment of the present invention.

FIG. 1 is a block diagram showing an example of the arrangement of an audio signal encoding apparatus according to this embodiment. In FIG. 1, the bold lines indicate a data signal, and the thin lines indicate a control signal.

In the arrangement shown in FIG. 1, reference numeral 1 denotes a frame divider which divides an audio input signal into frames as processing units. The audio input signal divided into frames is sent to a psychoacoustic processor 2 and filter bank 3 (to be described below).

Reference numeral 2 denotes a psychoacoustic processor, which analyzes the audio input signal for respective frames, and makes masking calculations in decomposed frequency bands more elaborate than SFBs. As a result of the arithmetic operations, a block type is output to the filter bank 3, and a signal to mask ratio (SMR) for each SFB is output to a scale factor calculator 4.

Reference numeral 3 denotes a filter bank, which applies a window of the block type designated by the psychoacoustic processor 2 to a time signal input from the frame divider 1, and then executes time-frequency transformation by a designated block length, thus converting the time signal into a frequency spectrum.

Reference numeral 4 denotes a scale factor calculator, which calculates allowable error energies for respective SFBs based on the SMRs (signal to mask ratios) for respective SFBs and the frequency spectrum, and determines scale factors of all the SFBs based on the allowable error energies.

Reference numeral 5 denotes a spectrum assigned bits calculator, which calculates the number of bits to be assigned to a quantized spectrum code.

Reference numeral 6 denotes a quantized spectral total amount predictor, which predicts a quantized spectral total amount based on the number of spectrum assigned bits.

Reference numeral 7 denotes a quantization step calculator, which calculates a quantization step by calculating a perceptual information amount of spectrum before quantization, and subtracting the calculated quantized information amount from the quantized spectral total amount.

Reference numeral 8 denotes a spectrum quantizer, which quantizes respective frequency spectrum.

Reference numeral 9 denotes a bit shaper, which shapes the scale factors and quantized spectrum to a predetermined format, as needed, to generate and output a bitstream.

The audio signal processing operation in the audio signal encoding apparatus with the above arrangement will be described below.

Note that this embodiment will give the following explanation taking MPEG-2 AAC as an example of the encoding scheme for the sake of descriptive convenience. However, the present invention can be implemented by the same method using other encoding schemes to which a similar quantization scheme can be applied.

Prior to the processing, respective units are initialized. With this initialization, the quantization step and all scale factor values are set to be zero.

The frame divider 1 divides an audio input signal such as an audio PCM signal or the like into frames, which are sent to the psychoacoustic processor 2 and filter bank 3. In case of an MPEG-2 AAC LC (Low-Complexity) profile, one frame is composed of 1024 samples of PCM signals, which are to be output.

The psychoacoustic processor 2 analyzes input signals output from the frame divider 1 as needed to perform auditory masking analysis, and outputs a block type to the filter bank 3 and the signal to mask ratio (SMR) for each SFB to the scale factor calculator 4. Note that the analysis and masking calculations made in the psychoacoustic processor 2 are known to those who are skilled in the art, and a detailed description thereof will not be made.

The filter bank 3 transforms time domain signals for 2048 samples, i.e., two frames including an input signal of the current frame and that of the preceding frame from the frame divider 1, into frequency domain signals in accordance with the block type output from the psychoacoustic processor 2. In this embodiment, the input signal of the preceding frame is held in a buffer in the filter bank 3. When the block type uses a long block length, the filter bank 3 applies a window with a shape according to the block type to one block including 2048 samples of the input signals, executes an MDCT, and outputs 1024 frequency spectrum. When the block type uses a short block length, the filter bank 3 applies a window to one block including 256 samples to have the 448th sample as a head of the 2048 samples of the input signals. After that, the filter bank 3 performs a transformation that executes an MDCT to output 128 frequency components eight times while shifting the input signals by 128 samples. In this way, eight sets of frequency spectrum are obtained.

The scale factor calculator 4 calculates allowable error energies for respective SFBs based on the spectrum components output from the filter bank 3 and the SMR values for respective SFBs output from the psychoacoustic processor 2, and calculates scale factors for respective SFBs based on the calculated allowable error energies. Since the method of calculating scale factors based on the allowable error energies is known to a person skilled in the art, a detailed description thereof will not be made. For example, when the scheme described in A. D. Duenes, R. Perez, B. Rivas, et al., "A robust and efficient implementation of MPEG-2/4 AAC Natural Audio Coders," AES 112$^{th}$ Convention Paper (2002), discussed above, is used, in MPEG-2 AAC, scale factor scalefac [b] in SFB b can be calculated by:

$$scalefac[b] = Int\left[-\frac{16}{3}\cdot\left[\frac{1}{2}\cdot\log_2 xmin[b] + \log_2\left(\frac{3}{4}\right) - \frac{1}{4}\cdot\log_2 x_{avg}\right]\right] \quad (2)$$

where $x_{avg}$ is the average level of spectrum components included in SFB b. Also, xmin[b] is the allowable error energy of SFB b. Let energy[b] be the spectrum energy of SFB b, SMB[b] be the signal to mask ratio, and sfb_width[b] be the number of spectrum included in SFB b. Then, this xmin[b] is given by:

$$xmin[b] = \frac{\text{energy}[b]}{SMR[b]} \Big/ \text{sfb_width}[b] \quad (3)$$

The spectrum assigned bits calculator 5 calculates the number of bits upon Huffman-encoding the scale factors output from the scale factor calculator 4, and subtracts it from the number of designated frame bits. In this way, the calculator 5 calculates the number of bits to be assigned to quantized spectrum, and outputs it to the quantized spectral total amount predictor 6.

The quantized spectral total amount predictor 6 makes a prediction calculation of a quantized spectral total amount based on the number of bits output from the spectrum assigned bits calculator 5. In this embodiment, this calculation is made using an approximate expression created based on an actual measurement result of the relationship between the number of spectrum assigned bits and the quantized spectral total amount upon quantizing by a conventional quantizer. For example, let F(x) be this approximate expression, and spectrum_bits be the number of spectrum assigned bits. Then, the predicted quantized spectral total amount can be calculated by:

$$\sum_i X_q \approx F(\text{spectrum_bits}) \tag{4}$$

The quantization step calculator 7 calculates the sum total of values obtained by multiplying the frequency spectrum output from the filter bank 3 by the scale factors as perceptual weights, and calculates a perceptual information amount of frequency spectrum before quantization based on this sum total. Then, the calculator 7 calculates an information amount of the quantized spectrum based on the quantized spectral total amount output from the quantized spectral total amount predictor 6.

Finally, the calculator 7 calculates a quantization step as a quantization coarseness of the whole frame by subtracting the quantized spectral information amount from the perceptual information amount of the spectrum before quantization, and multiplying the difference by a coefficient obtained from a step width of the quantization coarseness.

More specifically, in case of MPEG-2 AAC, the predicted value of the quantization step is obtained by calculating:

$$\text{global_gain} = Int\left[\frac{16}{3}\cdot\left[\log_2\sum_i\left[|x_i|^{\frac{3}{4}}\cdot 2^{\frac{3}{16}\cdot scalefac}\right]-\log_2\sum_i X_q\right]\right] \tag{5}$$

where $X_q$ is the quantized spectrum, $x_i$ is the spectrum before quantization, global_gain is the global gain (quantization step), and scalefac is the scale factor of the SFB that includes this spectrum component. The range of i for which the sum total is calculated is for one frame, i.e., $0 \leqq i \leqq 1023$.

In equation (5), the first term of the right-hand side below:

$$\log_2\sum_i\left[|x_i|^{\frac{3}{4}}\cdot 2^{\frac{3}{16}\cdot scalefac}\right]$$

is the perceptual information amount of the whole spectrum before quantization, i.e., the sum total of the values obtained by multiplying the respective spectrum by the scale factors as auditory weights. On the other hand, $$\log_2\sum_i X_q$$

as the second term of the right-hand side is the information amount of the spectrum, and $$\sum_i X_q$$

of this term is the sum total of the quantized spectrum, i.e., the value predicted by the quantized spectral total amount predictor 6. This value can be obtained by calculating, e.g., approximate expression (4), as described above.

Note that equation (5) can be obtained by modifying spectrum quantization equation (1) as needed.

The spectrum quantizer 8 quantizes the 1024 frequency spectrum in accordance with the scale factors output from the scale factor calculator 4 and the quantization step output from the quantization step calculator 7. More specifically, in case of, e.g., MPEG-2 AAC, the quantizer 8 calculates quantized spectrum using equation (1), and counts the number of bits consumed by the whole frame.

If the number of use bits exceeds the number of spectrum assigned bits, the spectrum quantization is repeated by increasing the quantization step so that the number of use bits becomes equal to or smaller than the number of spectrum assigned bits. However, since the calculation of the quantization step calculator 7 is accurate, the quantized spectrum calculation and bit calculation are made only once in many cases.

The bit shaper 9 shapes the scale factors of respective SFBs and quantized spectrum into a bitstream according to the predetermined format, and outputs the bitstream.

As described above, the audio signal encoding apparatus according to this embodiment predicts the spectral total amount after quantization based on the number of bits assigned to each frame, and calculates the difference between the information amounts of all the spectrum before and after quantization. As a result, the quantization step can be approximately accurately predicted before spectrum quantization. For this reason, the number of repetition times for adjustment of the quantization step is reduced, and the quantization processing can be completed quickly.

Second Embodiment

The present invention can also be practiced as a software program which runs on a general-purpose computer such as a personal computer (PC) or the like.

Figure 5:
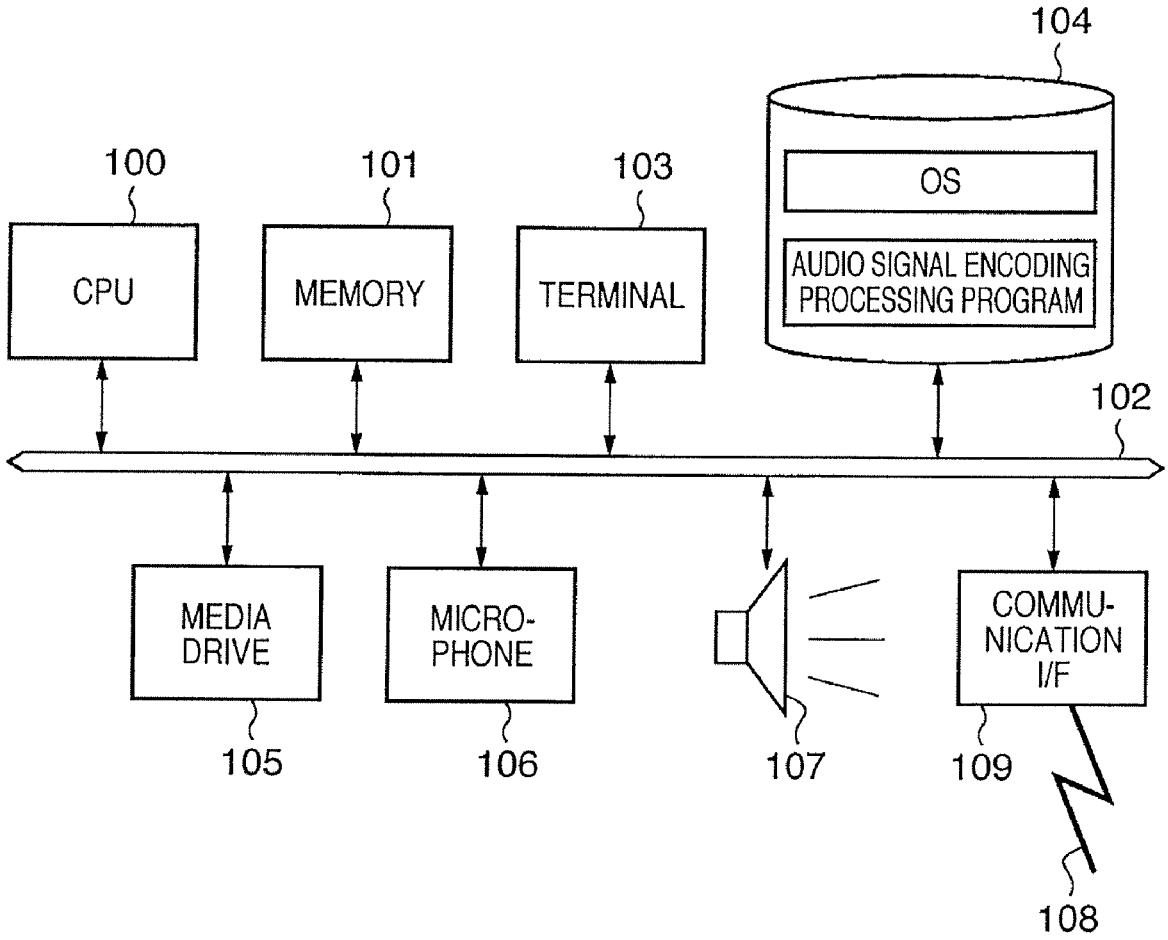
FIG. 5 is a block diagram showing an example of the arrangement of an audio signal encoding apparatus according to the second embodiment of the present invention.

FIG. 5 is a block diagram showing an example of the arrangement of an audio signal encoding apparatus according to this embodiment.

In the arrangement shown in FIG. 5, reference numeral 100 denotes a CPU which makes arithmetic operations, logical decisions, and the like for audio signal encoding processing, and controls respective building components via a bus 102.

Reference numeral 101 denotes a memory which stores a basic I/O program in the arrangement example of this embodiment, program codes in execution, data required upon program processing, and the like.

Reference numeral 102 denotes a bus, which transfers an address signal that designates a building component to be controlled by the CPU 100, transfers a control signal of each building component to be controlled by the CPU 100, and performs data transfer among the respective building components.

Reference numeral 103 denotes a terminal which starts up the apparatus, sets various conditions and input signals, and issues an encoding start instruction.

Reference numeral 104 denotes an external storage device which provides an external storage area for storing data, programs, and the like, and is implemented by, e.g., a hard disk drive or the like. The external storage device 104 stores programs, data, and the like in addition to an OS, and the CPU 100 calls the stored data and programs as needed. As will be described later, an audio signal encoding processing program is also installed in this external storage device 104.

Reference numeral 105 denotes a media drive. When this media drive 105 reads programs, data, digital audio signals, and the like recorded on a recording medium (e.g., a CD-ROM), they are loaded into the audio signal encoding apparatus. Also, the media drive 105 can write various data and execution programs stored in the external storage device 104 on a recording medium.

Reference numeral 106 denotes a microphone which collects an actual sound and converts it into an audio signal. Reference numeral 107 denotes a loudspeaker which can output arbitrary audio signal data as an actual sound.

Reference numeral 108 denotes a communication network, which includes a LAN, public line, wireless line, broadcast wave, and the like. Reference numeral 109 denotes a communication interface, which is connected to the communication network 108. The audio signal encoding apparatus of this embodiment communicates with an external device through the communication network 108 via this communication interface 109, and can exchange data and programs.

The audio signal encoding apparatus with the above arrangement operates in accordance with various inputs from the terminal 103. Upon reception of an input from the terminal 103, an interrupt signal is supplied to the CPU 100, which reads out various control signals stored in the memory 101, and makes various kinds of control according to these control signals.

The audio signal encoding apparatus of this embodiment operates when the CPU 100 executes the basic I/O program stored in the memory 101, thereby loading and executing the OS stored in the external storage device 104 onto the memory 101. More specifically, when the power switch of the apparatus is turned on, an IPL (initial program loading) function in the basic I/O program loads the OS from the external storage device 104 onto the memory 101, thus starting the operation of the OS.

Figure 2:
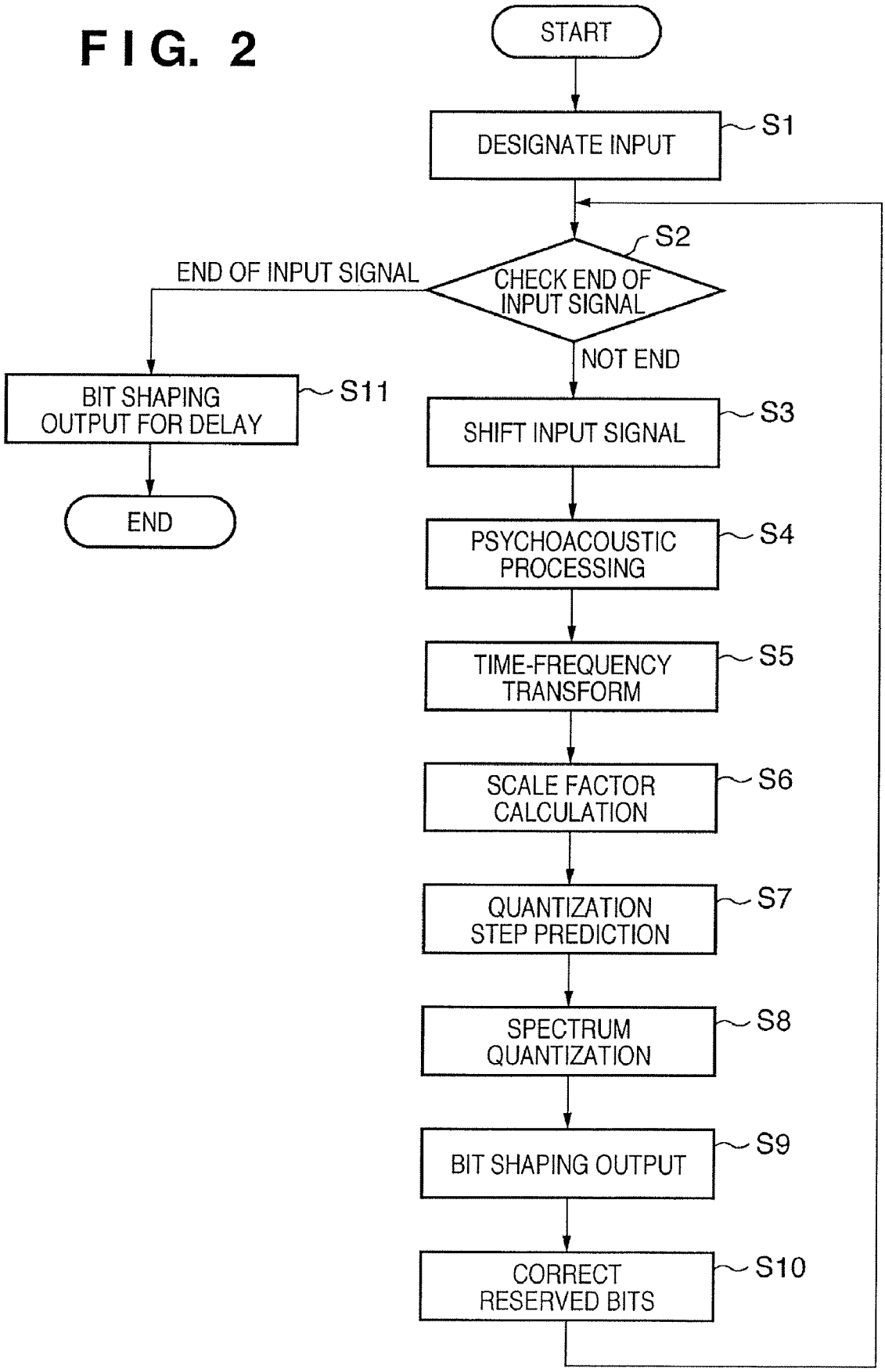
FIG. 2 is a flowchart of audio signal encoding processing according to the second embodiment of the present invention.

The audio signal encoding processing program is converted into program codes based on the flowchart of the audio signal encoding processing sequence shown in FIG. 2.

Figure 6:
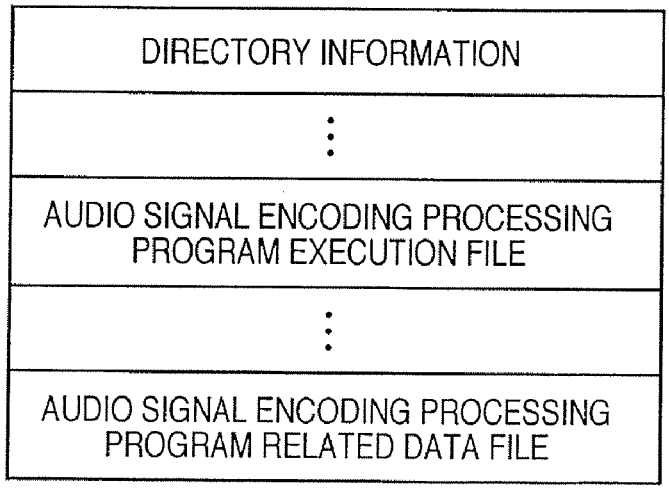
FIG. 6 shows an example of the configuration of the contents of a storage medium that stores an audio signal encoding processing program according to the second embodiment of the present invention.

FIG. 6 shows an example the configuration of the contents of a recording medium which records the audio signal encoding processing program and related data. In this embodiment, the audio signal encoding processing program and related data are recorded in the recording medium. As shown in FIG. 6, directory information of the recording medium is recorded in a start area of the recording medium, and the audio signal encoding processing program and audio signal encoding processing related data are recorded as files in subsequent areas.

Figure 7:
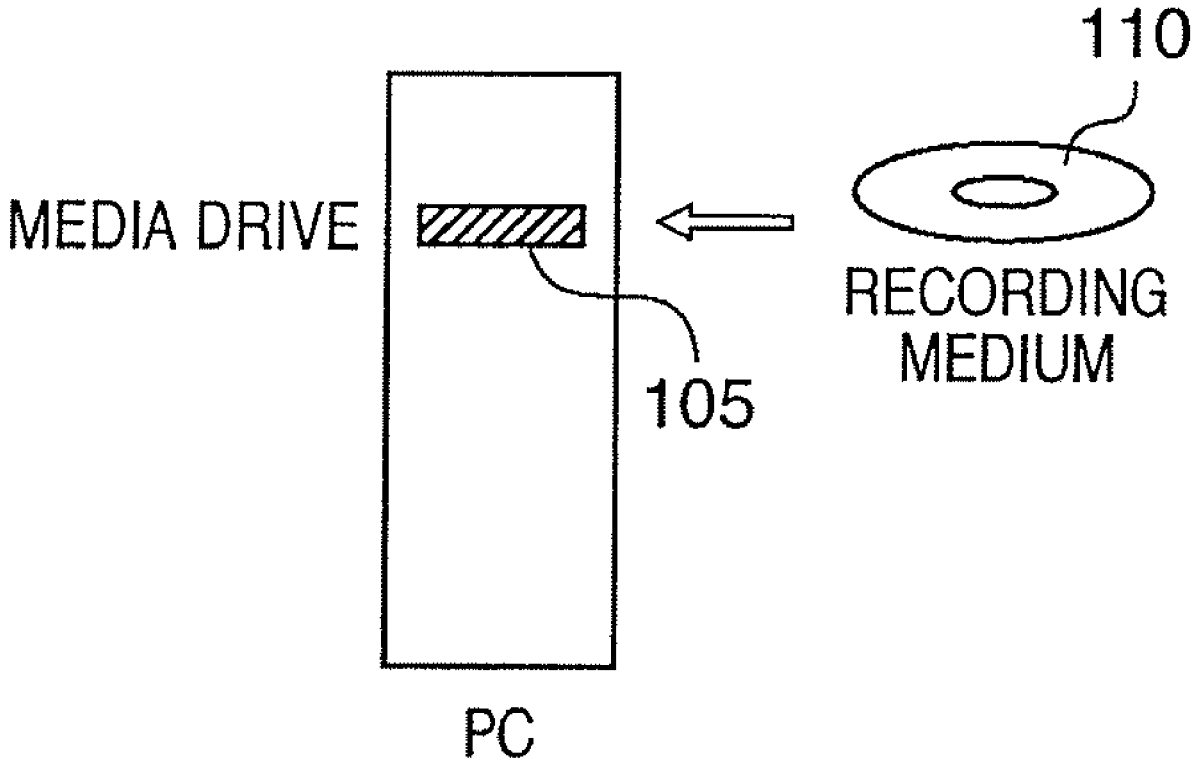
FIG. 7 is a diagram showing installation of the audio signal encoding processing program according to the second embodiment of the present invention in a PC.

FIG. 7 is a diagram of installation of the audio signal encoding program in the audio signal encoding apparatus (PC). The audio signal encoding processing program and related data recorded in the recording medium can be loaded onto the apparatus of this embodiment via the media drive 105, as shown in FIG. 7. When a recording medium 110 is set in the media drive 105, the audio signal encoding processing program and related data are read out from the recording medium 110 under the control of the OS and basic I/O program, and are stored in the external storage device 104. After that, these pieces of information are loaded onto the memory 101 upon restarting, and are ready to run.

Figure 8:
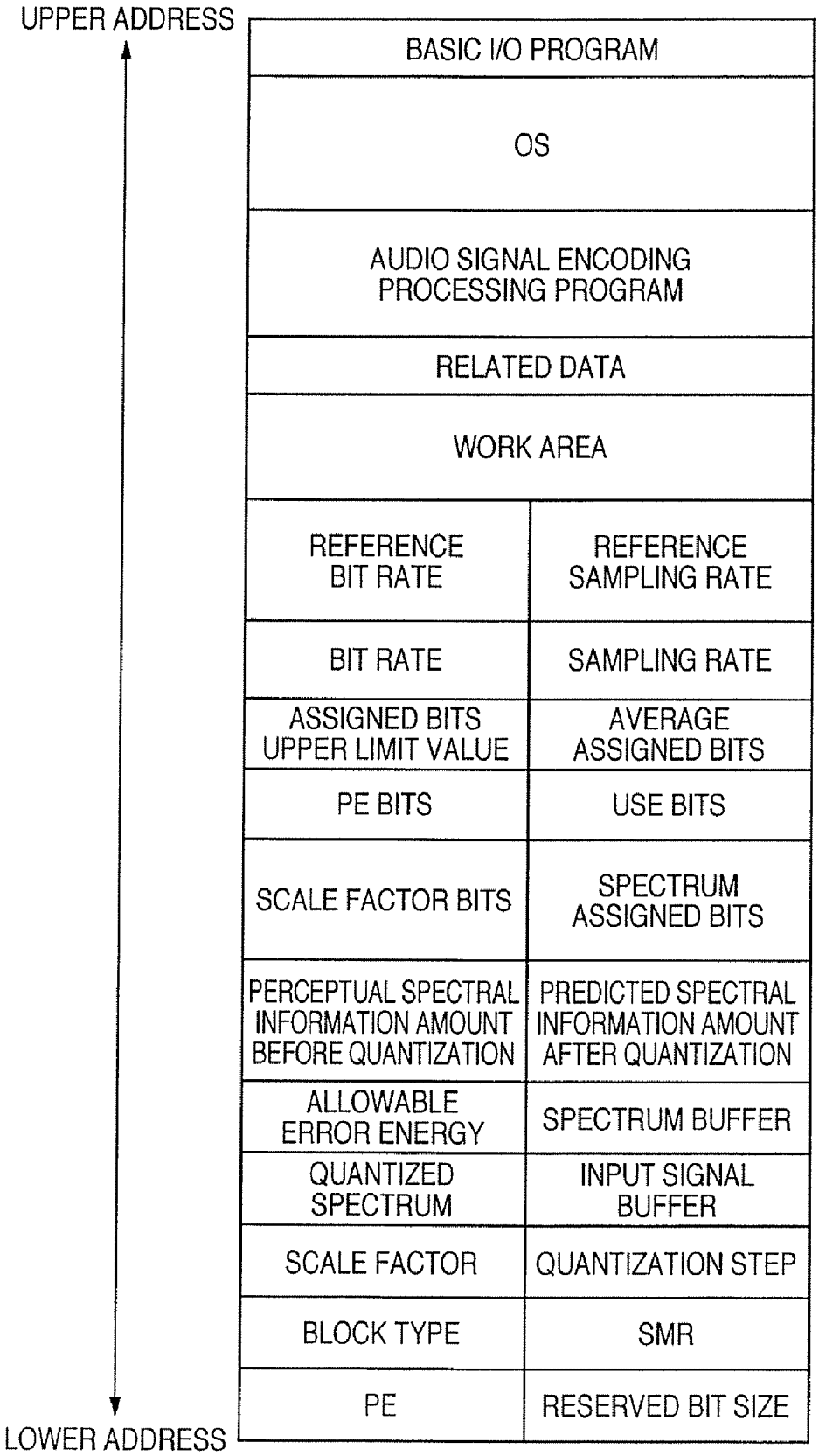
FIG. 8 shows an example of the memory map according to the second embodiment of the present invention.

FIG. 8 shows the memory map when the audio signal encoding processing program of this embodiment is loaded onto the memory 101 and is ready to run. As shown in FIG. 8, a work area of the memory 101 stores, e.g., a reference bit rate, reference sampling rate, bit rate, and sampling rate. This work area also stores an assigned bits upper limit value, the number of average assigned bits, the number of PE bits, the number of use bits, the number of scale factor bits, the number of spectrum assigned bits, a perceptual spectral information amount before quantization, and a spectrum predicted information amount after quantization. Furthermore, the work area stores allowable error energies, a spectrum buffer, quantized spectrum, an input signal buffer, scale factors, a quantization step, block types, SMRs, PE, and a reserved bit size.

Figure 9:
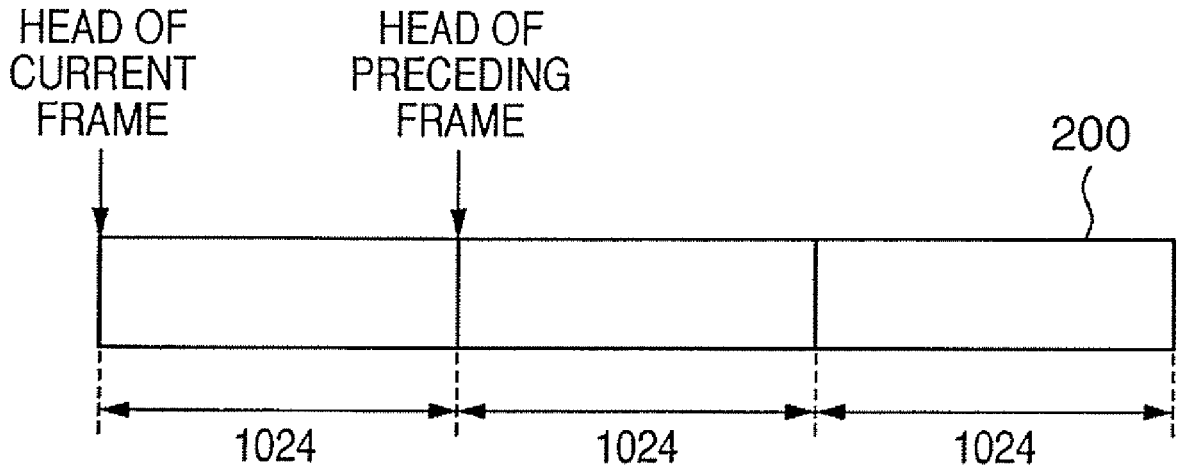
FIG. 9 shows an example of the configuration of an input signal buffer according to the second embodiment of the present invention.

FIG. 9 shows an example of the configuration of an input signal buffer in the audio signal encoding apparatus of this embodiment. In the configuration shown in FIG. 9, the buffer size is 1024×3 samples, and is divided by vertical lines for every 1024 samples for the sake of descriptive convenience. Input signals for one frame, i.e., 1024 samples, are input, and undergo batch processing from the left. Note that the configuration shown in FIG. 9 illustrates an input signal buffer for one channel, and similar buffers are prepared as many as the number of channels of input signals in this embodiment.

The audio signal encoding processing executed by the CPU 100 in this embodiment will be described below with reference to the flowcharts.

FIG. 2 is a flowchart of the audio signal encoding processing in this embodiment. The program corresponding to this flowchart is included in the audio signal encoding processing program, and is loaded onto the memory 101 and is executed by the CPU 100, as described above.

Step S1 is processing in which the CPU 100 allows the user to designate an input audio signal to be encoded using the terminal 103. In this embodiment, an audio signal to be encoded may be an audio PCM file stored in the external storage device 104 or may be a signal obtained by analog-to-digital converting a real-time audio signal captured by the microphone 106. Upon completion of this processing, the process advances to step S2.

Step S2 is processing in which the CPU 100 checks if the input audio signal to be encoded ends. If the input signal ends, the process advances to step S11. If the input signal does not end, the process advances to step S3.

Step S3 is input signal shift processing in which the CPU 100 shifts time signals for two frames, i.e. 2048 samples from the right to the left by one frame and loads new signals for one frame, i.e., 1024 samples on the right side in the input signal buffer shown in FIG. 9. This processing is done for all channels included in the input signal. Upon completion of the processing, the process advances to step S4.

Step S4 is processing in which the CPU 100 analyzes the time signals stored in the input signal buffer, and makes psychoacoustic arithmetic operations of the current frame. As a result of the arithmetic operations, the CPU 100 calculates the block type, perceptual entropy (PE), and SMR values for respective SFBs of the current frame, and stores them in the work area on the memory 101. Note that the CPU 100 calculates eight sets of SMR values for a short block when the block length of the current frame is short or one set of SMR values for a long block when the block type is other than the short block. Such auditory arithmetic operations are known to those who are skilled in the art, and a detailed description thereof will not be given. Upon completion of the processing, the process advances to step S5.

In step S5, the CPU 100 applies a window to time signals for the current frame, i.e., signals for 2048 samples (two frames) from a current frame start pointer shown in FIG. 9 in accordance with the block type obtained in step S4, and then executes time-frequency transform. As a result, in case of MPEG-2 AAC, the CPU 100 obtains eight sets of spectrum decomposed into 128 frequency components when the transform block length is short. Otherwise, the CPU 100 obtains one set of spectrum decomposed into 1024 frequency components in case of the block type of a long block length. In either case, the CPU 100 stores a total of calculated 1024 spectrum in a spectrum buffer assured in the work area on the memory 101. Upon completion of processing, the process advances to step S6.

Step S6 is processing in which the CPU 100 calculates allowable error energy based on the frequency spectrum obtained in step S5 and the SMR values for respective SFBs obtained in step S4, and calculates scale factors for respective SFBs using the allowable error energies. For example, in case of MPEG-2 AAC, the CPU 100 calculates the scale factors using equation (2) of the aforementioned first embodiment. The CPU 100 stores the allowable error energies and scale factors for respective SFBs calculated by this processing on the work area on the memory 100. Upon completion of the processing, the process advances to step S7.

Step S7 is processing in which the CPU 100 calculates a quantization step based on the difference between the perceptual information amount of spectrum before quantization, and that of the quantized spectrum. Details of this processing will be described later with reference to FIG. 3. Upon completion of the processing, the process advances to step S8.

In step S8, the CPU 100 calculates the number of use bits by quantizing the 1024 frequency spectrum according to the scale factors calculated in step S6 and the quantization step calculated in step S7. When the number of use bits exceeds the number of assigned bits stored in the work area on the memory 101, the CPU 100 increments the quantization step and executes re-quantization. Details of this processing will be described later with reference to FIG. 4. Upon completion of the processing, the process advances to step S9.

Step S9 is processing in which the CPU 100 shapes the quantized spectrum calculated in step S8 and the scale factors according to the format specified by the encoding scheme, and outputs them as a bitstream. In this embodiment, the CPU 100 may store the bitstream output by this processing in the external storage device 104 or may output the bitstream to an external device connected to the communication network 108 via the communication interface 109. Upon completion of the processing, the process advances to step S10.

Step S10 is processing in which the CPU 100 corrects the number of reserved bits stored on the memory 101 from the bit size used in the bitstream output in step S9 and the encoding bit rate. Upon completion of the processing, the process returns to step S2.

Step S11 is processing in which as quantized spectrum to be output still remain on the memory due to a delay caused by the psychoacoustic arithmetic operations, orthogonal transformation, and the like, the CPU 100 shapes them into a bitstream and outputs the bitstream. Upon completion of the processing, the audio signal encoding processing ends.

Figure 3:
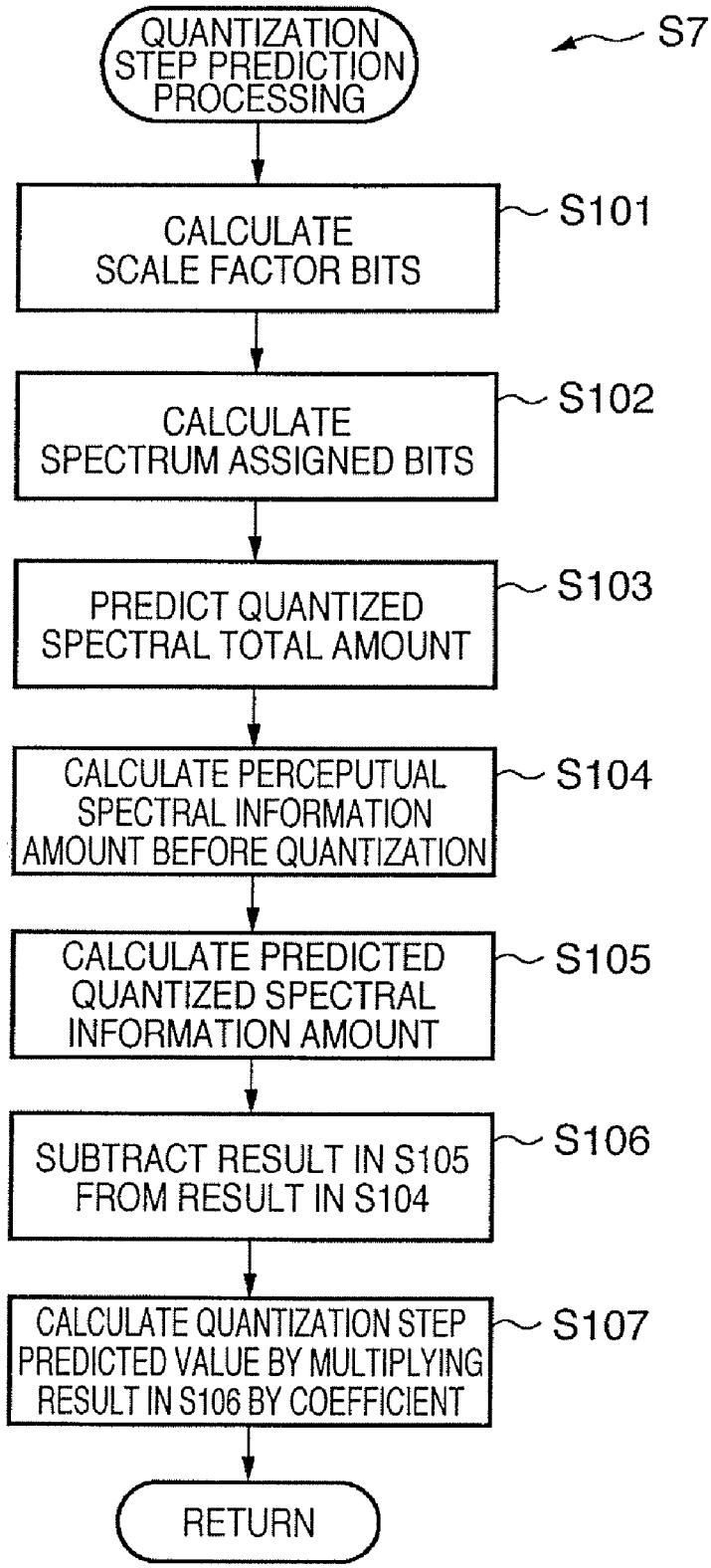
FIG. 3 is a flowchart of quantization step prediction processing according to the second embodiment of the present invention.

FIG. 3 is a flowchart showing details of the quantization step prediction processing in step S7 described above.

Step S101 is processing in which the CPU 100 calculates the number of bits used upon encoding the scale factor saved in the work area on the memory 101 according to the format specified by the encoding scheme. The CPU 100 saves the calculated number of bits in the work area on the memory 101. Upon completion of the processing, the process advances to step S102.

Step S102 is processing in which the CPU 100 calculates the number of bits to be assigned to spectrum codes by subtracting the number of scale factor bits stored on the memory 101 from the number of bits assigned to the frame. The CPU 100 saves the calculated number of spectrum assigned bits in the work area on the memory 101. Upon completion of the processing, the process advances to step S103.

Step S103 is processing in which the CPU 100 makes a prediction calculation of the quantized spectral total amount using the number of spectrum assigned bits on the memory 101. The CPU 100 makes this prediction calculation using an approximate expression obtained by conducting experiments in advance. For example, let F(x) be this approximate expression, and spectrum_bits be the number of spectrum assigned bits. Then, the quantized spectrum predicted total size can be calculated by:

$$\sum_i X_q \approx F(\text{spectrum_bits}) \tag{4}$$

The CPU 100 stores the calculated quantized spectrum predicted total size in the work area on the memory 100. Upon completion of the processing, the process advances to step S104.

Step S104 is processing in which the CPU 100 calculates an perceptual information amount of spectrum before quantization. The CPU 100 calculates the perceptual information amount of spectrum before quantization by calculating a total size for one frame by multiplying each spectrum component by a decrement of the quantization coarseness due to the scale factor of the SFB that includes the spectrum component of interest, and then calculating its logarithm. For example, in case of MPEG-2 AAC, the perceptual information amount of spectrum before quantization can be calculated by:

$$\log_2 \sum_i \left[ |x_i|^{\frac{3}{4}} \cdot 2^{\frac{3}{16} \cdot scalefac} \right] \tag{6}$$

The CPU 100 saves the calculated perceptual information amount of spectrum before quantization in the work area on the memory 101. Upon completion of the processing, the process advances to step S105.

Step S105 is processing in which the CPU 100 calculates a quantized spectrum predicted information amount by calculating the logarithm of the quantized spectrum predicted total size calculated in step S103. For example, in case of MPEG-2 AAC, the CPU 100 can calculate the quantized spectrum predicted information amount by calculating:

$$\log_2 \sum_i X_q \tag{7}$$

That is, the CPU 100 can obtain the quantized spectrum predicted information amount by calculating the logarithm of the quantized spectral total amount obtained in step S103. The CPU 100 saves the quantized spectral information amount calculated by this processing in the work area on the memory 101. Upon completion of the processing, the process advances to step S106.

In step S106, the CPU 100 subtracts the quantized spectrum predicted information amount calculated in step S105 from the perceptual information amount of spectrum before quantization calculated in step S104. The CPU 100 calculates a global gain, i.e., a predicted value of a quantization step by multiplying the difference by a coefficient determined by the step width of the quantization coarseness in step S107. In case of MPEG-2 AAC, calculating this predicted value amounts to calculating equation (5) as in the first embodiment.

$$\text{global_gain} = Int\left[\frac{16}{3}\cdot\left[\log_2\sum_i\left[|x_i|^{\frac{3}{4}}\cdot 2^{\frac{3}{16}\cdot scalefac}\right]-\log_2\sum_i X_q\right]\right] \quad (5)$$

The CPU 100 stores the calculated quantization step predicted value as the quantization step in the work area on the memory 101. Upon completion of the processing, the control ends the quantization step prediction processing, and returns to the previous routine.

Figure 4:
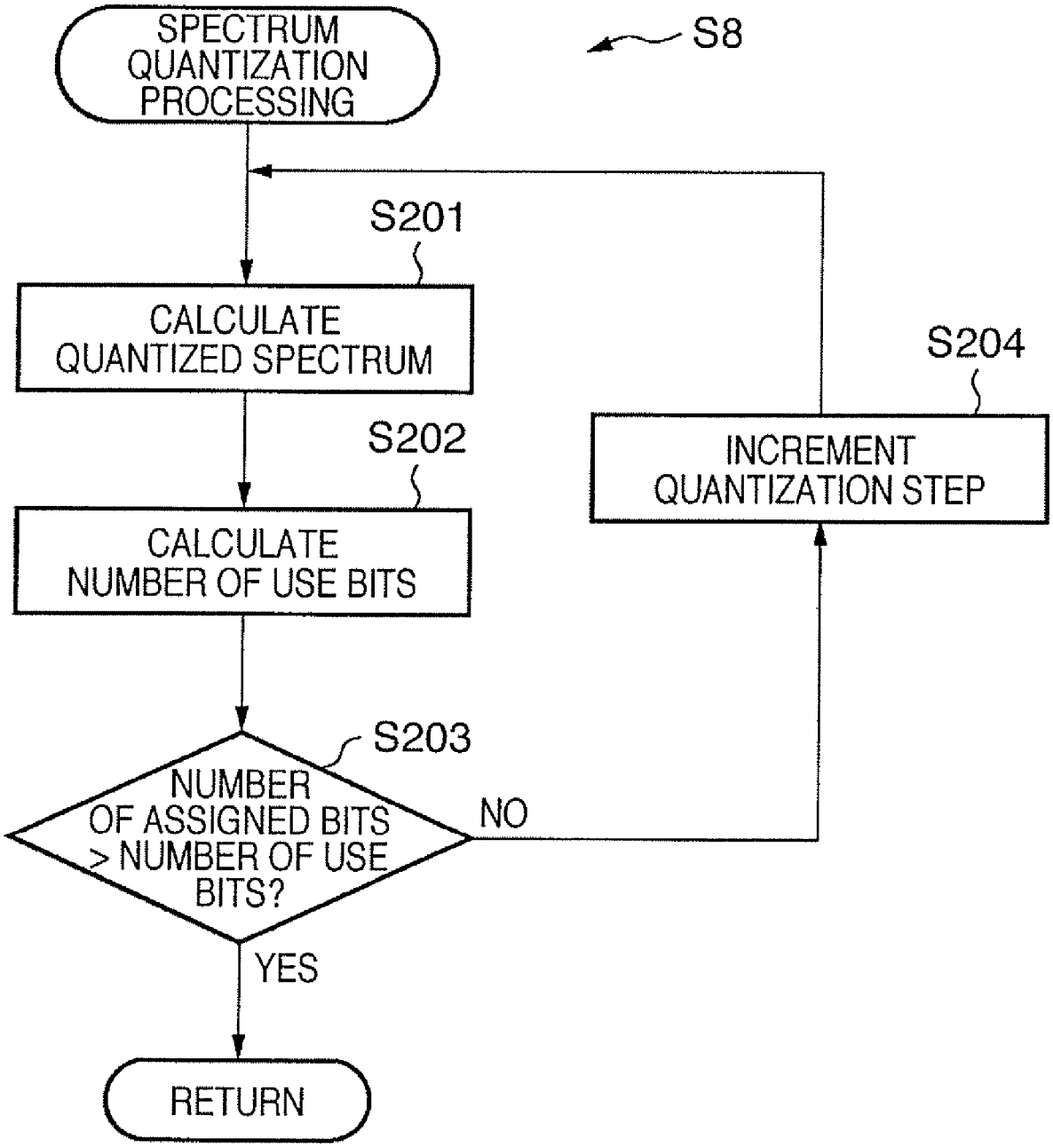
FIG. 4 is a flowchart of spectrum quantization processing according to the second embodiment of the present invention.

FIG. 4 is a flowchart showing details of the spectrum quantization processing in step S8 described above.

Step S201 is processing in which the CPU 100 quantizes 1024 spectrum components stored in the spectrum buffer in accordance with the quantization step and scale factors stored on the memory 101. In case of MPEG-2 AAC, the CPU 100 calculates the quantized spectrum according to equation (1) above. Upon completion of the processing, the process advances to step S202.

Step S202 is processing in which the CPU 100 calculates the number of bits used upon encoding all the quantized spectrum calculated in step S201. For example, in case of MPEG-2 AAC, since a plurality of quantized spectrum are combined, and are then Huffman-encoded, the CPU 100 searches Huffman code tables and calculates the total of the numbers of encoded bits in this processing. The CPU 100 stores the calculated number of use bits in the work area on the memory 101. Upon completion of the processing, the process advances to step S203.

Step S203 is processing in which the CPU 100 compares the number of spectrum assigned bits with the number of use bits on the memory 101. As a result of comparison, if the number of use bits is larger than the number of assigned bits, the process advances to step S204 to increment the quantization step stored in the memory 101 so as to reduce the code amount. After that, the process returns to step S201 to quantize the spectrum again. However, since the aforementioned quantization step prediction processing approximately accurately predicts the quantization step, step S204 is rarely executed in practice.

As a result of comparison in step S203, if the number of use bits is smaller than the number of assigned bits, the control ends the spectrum quantization processing and returns to the previous routine.

As described above, in the audio signal encoding processing of this embodiment, the quantized spectral information amount is predicted based on the number of bits assigned to spectrum codes, and a difference from the perceptual information amount before quantization is also calculated. In this way, since the quantization step is approximately accurately predicted before actual quantization, adjustment of the quantization step can be avoided as much as possible, and the computational complexity required for the quantization processing can be greatly reduced.

Third Embodiment

The technique of the present invention can be applied to even a case in which reserved bits reserved in the bit reservoir are distributed to respective frames as needed depending on the characteristics of an input signal upon encoding at a fixed bit rate. This embodiment will explain this case with reference to the drawings.

Figure 10:
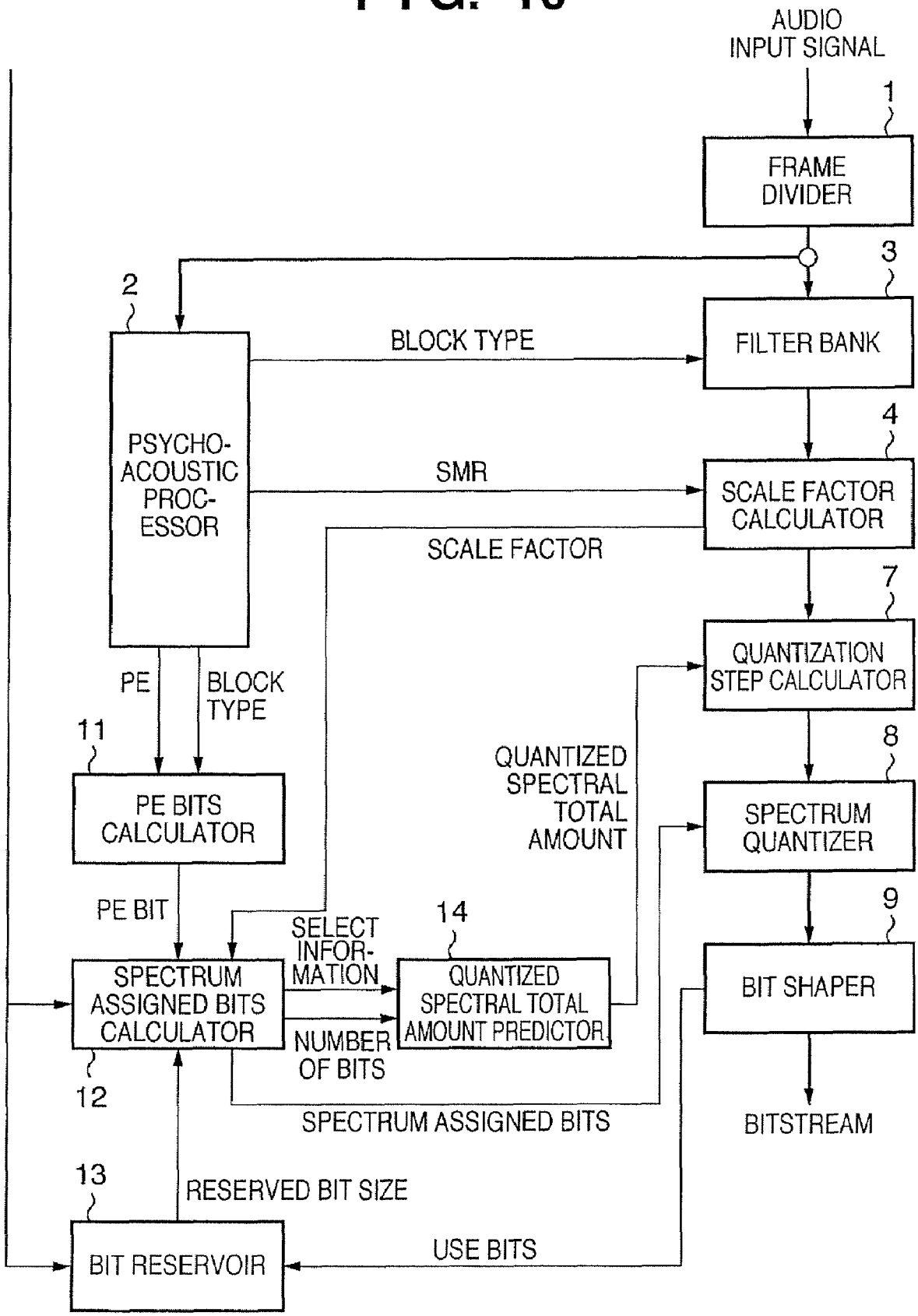
FIG. 10 is a block diagram showing an example of the arrangement of an audio signal encoding apparatus according to the third embodiment of the present invention.

FIG. 10 is a block diagram showing an example of the arrangement of an audio signal encoding apparatus according to this embodiment. As in FIG. 1 according to the first embodiment, in FIG. 10, the bold lines indicate a data signal, and the thin lines indicate a control signal. Also, in FIG. 10, the same reference numerals denote the same building components having the same functions as in FIG. 1.

In the arrangement shown in FIG. 10, reference numeral 1 denotes a frame divider; 2, a psychoacoustic processor; 3, a filter bank; 4, a scale factor calculator; 7, a quantization step calculator; 8, a spectrum quantizer; and 9, a bit shaper.

Reference numeral 11 denotes a PE calculator, which calculates the number of PE bits as a predicted generation code amount of a frame based on a perceptual entropy (PE) of the frame.

Reference numeral 12 denotes a spectrum assigned bits calculator, which calculates the number of bits to be assigned to spectrum codes based on the bit rate, the number of PE bits, the reserved bit size, the scale factors, and the like.

Reference numeral 13 denotes a bit reservoir, which sequentially manages the reserved bit size specified according to the encoding scheme.

Reference numeral 14 denotes a quantized spectral total amount predictor, which predicts a quantized spectral total amount based on the number of frame assigned bits or PE bits depending on conditions.

The processing operation in the audio signal encoding apparatus with the above arrangement will be described below. Note that this embodiment will give the following explanation taking MPEG-2 AAC as an example of the encoding scheme for the sake of descriptive convenience. However, the present invention can be implemented by the same method in other encoding schemes that make nonlinear quantization.

Prior to the processing, respective units are initialized. With this initialization, the quantization step and all scale factor values are set to be zero.

The frame divider 1 divides an audio input signal into frames, which are output to the psychoacoustic processor 2 and filter bank 3.

The psychoacoustic processor 2 performs auditory masking analysis as needed to the input signals output from the frame divider 1, and outputs a block type and SMR and PE values for respective SFBs.

The filter bank 3 performs a time-frequency transform of input signals for two frames, i.e., one frame output from the frame divider 1 and one preceding frame held in the filter bank 3 in accordance with the block type output from the psychoacoustic processor 2, thus converting them into frequency spectrum.

The scale factor calculator 4 calculates scale factors as needed as in the first embodiment based on the frequency spectrum output from the filter bank 3 and the SMR values for respective SFBs output from the psychoacoustic processor 2.

The PE bits calculator 11 calculates the number of PE bits from the PE values output from the psychoacoustic processor 2. That is, the calculator 11 transforms a perceptual information amount of the input signal of the frame in processing into a predicted code amount upon encoding auditorily completely encoding it. In case of MPEG-2 AAC, calculation equations of the number of PE bits described in the ISO written standards are:

When the block length is long:

$$pe_bits=0.3\cdot PE+6.0\cdot\sqrt{PE} \tag{8}$$

When the block length is short:

$$pe_bits=0.6\cdot PE+24.0\cdot\sqrt{PE} \tag{9}$$

This embodiment uses these calculation equations intact to calculate the number of PE bits according to the block lengths of the block type.

The spectrum assigned bits calculator 12 calculates the number of bits required to encode the scale factors output from the scale factor calculator 4 first. The calculator 12 then calculates the number of average spectrum assigned bits by calculating the difference from the average bit size per frame channel based on the bit rate.

Next, this value is compared with the number of PE bits output from the PE bits calculator 11. If the number of PE bits is larger, the PE bits are assigned up to the maximum value determined by the reserved bit size stored in the bit reservoir 13. If the number of PE bits is smaller, the average spectrum assigned bits are assigned intact.

That is, in this embodiment, in particular, the number of spectrum assigned bits is calculated in the following sequence:

1. A reserved bit useable size is calculated from the reserved bit size.

The reserved bit usable size is determined as:

10% of the reserved bit size when the block length is long, and

25% of the reserved bit size when the block length is short.

Let usable_bits be this size.

2. Let average_bits be the average spectrum assigned bit size. Then, a spectrum assigned bit size spectrum_bits is determined in the following manner.

spectrum_bits=average_bits+usable bits, when pe_bits>(average_bits+usable_bits);

spectrum_bits=average_bits, when pe_bits<average_bits; or spectrum_bits=pe_bits, otherwise, i.e., when average_bits≦pe_bits<(average_bits+usable_bits).

Next, when the number of PE bits is smaller than the average spectrum assigned bit size, the spectrum assigned bits calculator 12 outputs the number of PE bits to the quantized spectral total amount predictor 14. On the other hand, if the number of PE bits is equal to or larger than the number of average spectrum assigned bits, the calculator 12 outputs the number of spectrum assigned bits calculated in the above sequence to the quantized spectral total amount predictor 14. At this time, the calculator 12 simultaneously outputs bit select information (to be simply referred to as "select information" hereinafter) as a flag indicating which of the numbers of bits is output to the quantized spectral total amount predictor 14.

The quantized spectral total amount predictor 14 predicts a quantized spectral total amount based on the input select information and the number of bits. This prediction calculation is made using an experimentally obtained approximate expression as in the method described in the first embodiment. The quantized spectral total amount predictor 14 makes the prediction calculation by switching this approximate expression depending on the select information. For example, let F(x) be an approximate expression of the quantized spectral total amount based on the number of spectrum assigned bits, and G(x) be an approximate expression of the quantized spectral total amount based on the number of PE bits. Then, the spectrum predicted total size is calculated by the following equations.

When the select information indicates selection of the spectrum assigned bits:

$$\sum_i X_q \approx F(\text{spectrum_bits}) \tag{4}$$

When the select information indicates selection of the PE bits:

$$\sum_i X_q = \frac{\text{bit_rate}}{\text{base_bit_rate}}\cdot\frac{\text{base_sampling_rate}}{\text{sampling_rate}}\cdot G(\text{pe_bits}) \tag{10}$$

where bit_rate is the bit rate of the input signal in processing, and sampling_rate is the sampling rate of the input signal in processing. Also, base_bit_rate is the reference bit rate, and base_sampling_rate is the reference sampling rate. The reference bit rate and reference sampling rate are the bit rate and sampling rate of the input signal when quantized spectral total amount prediction equation G(x) is obtained experimentally. These values are predetermined values in the audio signal encoding apparatus of this embodiment.

The reason why this embodiment adopts the aforementioned prediction method of quantized spectrum will be described below.

In this embodiment, the spectrum assigned bits calculator 12 assigns bits with reference to the PE bits. Therefore, the PE bit size, i.e., the auditorily generated code amount of the input signal in the frame in processing is reflected in the number of spectrum assigned bits. However, in the fixed bit rate control, when the PE bit size is smaller than the average spectrum assigned bit size, the average spectrum assigned bits are assigned intact to the spectrum assigned bits. Therefore, in this case, since the auditorily generated code amount of the input signal is not reflected in the number of spectrum assigned bits, the prediction error becomes large if the quantized spectral total amount is predicted using the number of spectrum assigned bits. Hence, in this case, since the quantized spectral total amount is predicted using the number of PE bits, it can be predicted more accurately.

The number of spectrum assigned bits has characteristics that follow changes in bit rate and sampling rate since it is calculated in consideration of restrictions on the bit rate and sampling rate. On the other hand, as for the number of PE bits, although original PE values themselves change according to a change in sampling rate, equations (8) and (9) themselves remain unchanged even when the bit rate and sampling rate change. Hence, upon making prediction based on the number of PE bits, prediction is made in consideration of change rates from the reference bit rate and sampling rate, as given by equation (10).

In this way, one approximate expression G(x) can be applied to every bit rates and sampling rates.

The description will revert to FIG. 10. The quantization step calculator 7 calculates the total size of values obtained by weighting the frequency spectrum output from the filter bank 3 by the scale factors output from the scale factor calculator 4 as in the first embodiment. The quantization step calculator 7 calculates an perceptual information amount of spectrum before quantization by further calculating the logarithm of the total size. Next, the calculator 7 calculates a quantized spectral total amount by calculating the logarithm of the quantized spectral total amount predicted by the quantized spectral total amount predictor 14. Furthermore, the calculator 7 calculates a quantization step by calculating the difference between these sizes, and multiplying it by a coefficient determined by the step width of the quantization coarseness. More specifically, the calculator 4 calculates equation (5) above.

As in the first embodiment, the spectrum quantizer 8 quantizes the frequency spectrum output from the filter bank 3 using the scale factors output from the scale factor calculator 4 and the quantization step output from the quantization step calculator 7, and counts the number of required bits. This number of required bits is compared with the number of spectrum assigned bits output from the spectrum assigned bits calculator 12. When the number of required bits exceeds the number of spectrum assigned bits, the quantization step is incremented as needed to execute quantization again. However, as described above, since the predicted value of the quantization step by the quantization step calculator 7 is approximately accurate, this re-quantization is rarely done.

The bit shaper 9 entropy-encodes the quantized spectrum, scale factors, and quantization step finally output from the spectrum quantizer 8, then shapes them into a bitstream format specified by the encoding scheme, and outputs the bitstream.

At this time, the bit reservoir 13 is notified of the number of bits used in codes in practice, calculates the difference from the number of frame bits, and adds or subtracts the increment or decrement to or from the reserved bit size, thus adjusting the reserved bit size as needed.

As described above, even when reserved bits reserved in the bit reservoir are assigned to a frame as needed in accordance with an input signal at a fixed bit rate like in this embodiment, the quantized spectral total amount is accurately predicted prior to quantization. In this way, the quantization step can be accurately determined before quantization, and quantization can be efficiently done while avoiding repetition of the spectrum quantization and bit calculation.

Fourth Embodiment

The audio signal encoding apparatus described in the third embodiment can also be practiced as a software program which runs on a general-purpose computer such as a PC or the like. Such case will be described below with reference to the drawings.

The arrangement of the audio signal encoding apparatus, the processing contents of the audio signal encoding processing program, and the like in this embodiment are basically common to those of the second embodiment. Therefore, this embodiment will quote FIG. 5, FIG. 2, and FIGS. 6 to 9 described in the second embodiment, and will not repeat a detailed explanation thereof. The difference from the second embodiment lies in the contents of the quantization step prediction processing in step S7. Hence, only the quantization step prediction processing in step S7 will be described below.

Figure 11:
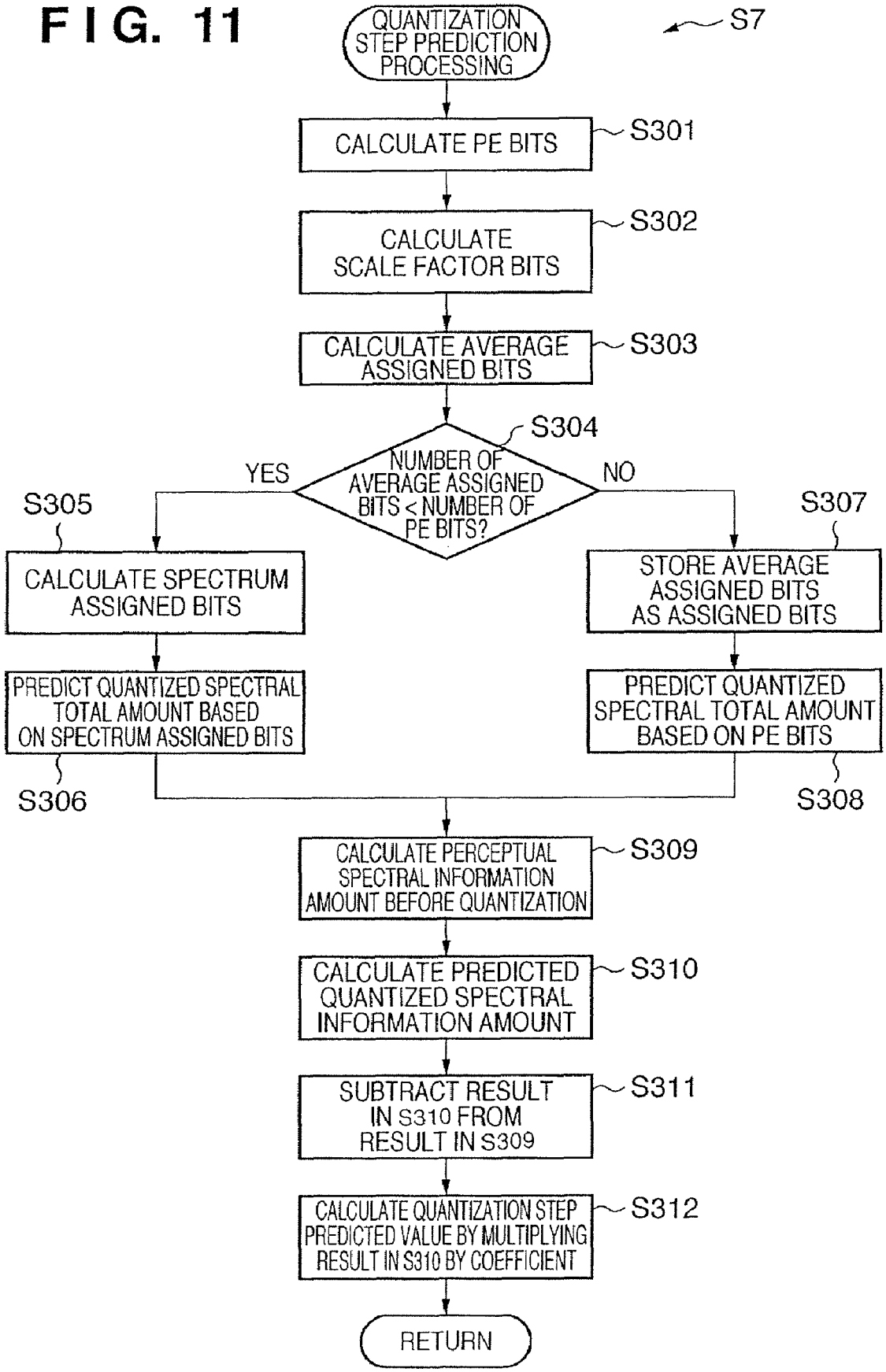
FIG. 11 is a flowchart of quantization step prediction processing according to the fourth embodiment of the present invention.

FIG. 11 is a flowchart showing details of the quantization step prediction processing in step S7 in this embodiment.

Step S301 is processing in which the CPU 100 calculates the number of PE bits based on the PE values and block type on the memory 101, which are obtained by the psychoacoustic arithmetic processing in step S4. More specifically, the CPU 100 selects equation (9) or (10) above according to the block type and calculates the number of PE bits as in the third embodiment. The CPU 100 stores the calculated number of PE bits in the work area on the memory 101. Upon completion of the processing, the process advances to step S302.

Step S302 is processing in which the CPU 100 calculates the number of bits used when the scale factors saved in the work area on the memory 101 are encoded to the format specified by the encoding scheme. The CPU 100 saves the number of scale factor bits calculated by this processing in the work area on the memory 101. Upon completion of the processing, the process advances to step S303.

Step S303 is processing in which the CPU 100 calculates the number of bits to be assigned to spectrum codes, i.e., the number of average spectrum assigned bits (average assigned bits) by subtracting the number of scale factor bits stored on the memory 101 from the number of average bits to be assigned to the frame. The CPU 100 saves the number of average assigned bits in the work area on the memory 101. Upon completion of the processing, the process advances to step S304.

Step S304 is processing in which the CPU 100 compares the number of average assigned bits and the number of PE bits on the memory 101. As a result of this comparison, if the number of PE bits is larger, the process advances to step S305; otherwise, the process advances to step S307.

Step S305 is processing in which the CPU 100 calculates the number of spectrum assigned bits based on the number of PE bits, the number of average assigned bits, and the reserved bit size on the memory 101. Details of this processing will be described later with reference to FIG. 12. Upon completion of the processing, the process advances to step S306.

Step S306 is processing in which the CPU 100 makes a prediction calculation of a quantized spectral total amount using the number of spectrum assigned bits on the memory 101. The CPU 100 makes this prediction calculation using an approximate expression obtained by conducting experiments in advance. For example, let F(x) be this approximate expression, and spectrum_bits be the number of spectrum assigned bits. Then, the predicted quantized spectral total amount can be calculated by:

$$\sum_i X_q \approx F(\text{spectrum_bits}) \tag{4}$$

The CPU 100 stores the calculated quantized spectral total amount in the work area on the memory 100. Upon completion of the processing, the process advances to step S309.

On the other hand, step S307 is processing in which the CPU 100 stores the number of average assigned bits on the memory 101 as the number of spectrum assigned bits. That is, the CPU 100 copies the value of the number of average assigned bits to the number of spectrum assigned bits. Upon completion of the processing, the process advances to step S308.

Step S308 is processing in which the CPU 100 makes a prediction calculation of a quantized spectral total amount using the number of PE bits on the memory 101. The CPU 100 also makes this prediction calculation using an approximate expression obtained by conducting experiments in advance. Let G(x) be this approximate expression, and pe_bits be the number of PE bits. Then, the quantized spectrum predicted total size can be calculated by equation (10) as in the third embodiment.

$$\sum_i X_q = \frac{\text{bit_rate}}{\text{base_bit_rate}} \cdot \frac{\text{base_sampling_rate}}{\text{sampling_rate}} \cdot G(\text{pe_bits}) \tag{10}$$

The CPU 100 stores the calculated spectrum predicted total size in the work area on the memory 101. Upon completion of the processing, the process advances to step S309.

Step S309 is processing in which the CPU 100 calculates an perceptual information amount of spectrum before quantization. The CPU 100 calculates the perceptual information amount of spectrum before quantization by calculating a total size for one frame by multiplying each spectrum component by a decrement of the quantization coarseness due to the scale factor of the SFB that includes the spectrum component of interest, and then calculating its logarithm. For example, in case of MPEG-2 AAC, the perceptual information amount of spectrum before quantization can be calculated by:

$$\log_2 \sum_i \left[ |x_i|^{\frac{3}{4}} \cdot 2^{\frac{3}{16} \cdot scalefac} \right] \tag{6}$$

The CPU 100 saves the calculated perceptual information amount of spectrum before quantization in the work area on the memory 101. Upon completion of the processing, the process advances to step S310.

Step S310 is processing in which the CPU 100 calculates a quantized spectrum predicted information amount by calculating the logarithm of the quantized spectrum predicted total size calculated in step S306 or S308. For example, in case of MPEG-2 AAC, the CPU 100 can calculate the quantized spectrum predicted information amount by calculating:

$$\log_2 \sum_i X_q \tag{7}$$

The CPU 100 saves the quantized spectral information amount calculated by this processing in the work area on the memory 101. Upon completion of the processing, the process advances to step S311.

In step S311, the CPU 100 subtracts the quantized spectrum predicted information amount calculated in step S310 from the perceptual information amount of spectrum before quantization calculated in step S309. The CPU 100 calculates a global gain, i.e., a predicted value of a quantization step by multiplying the difference by a coefficient determined by the step width of the quantization coarseness. In case of MPEG-2 AAC, this predicted value is obtained by consequently calculating equation (5) as in the first embodiment.

$$\text{global_gain} = Int\left[ \frac{16}{3} \cdot \left[ \log_2 \sum_i \left[ |x_i|^{\frac{3}{4}} \cdot 2^{\frac{3}{16} \cdot scalefac} \right] - \log_2 \sum_i X_q \right] \right] \tag{5}$$

The CPU 100 stores the calculated quantization step predicted value as the quantization step in the work area on the memory 101. Upon completion of the processing, the control ends the quantization step prediction processing, and returns to the previous routine.

Figure 12:
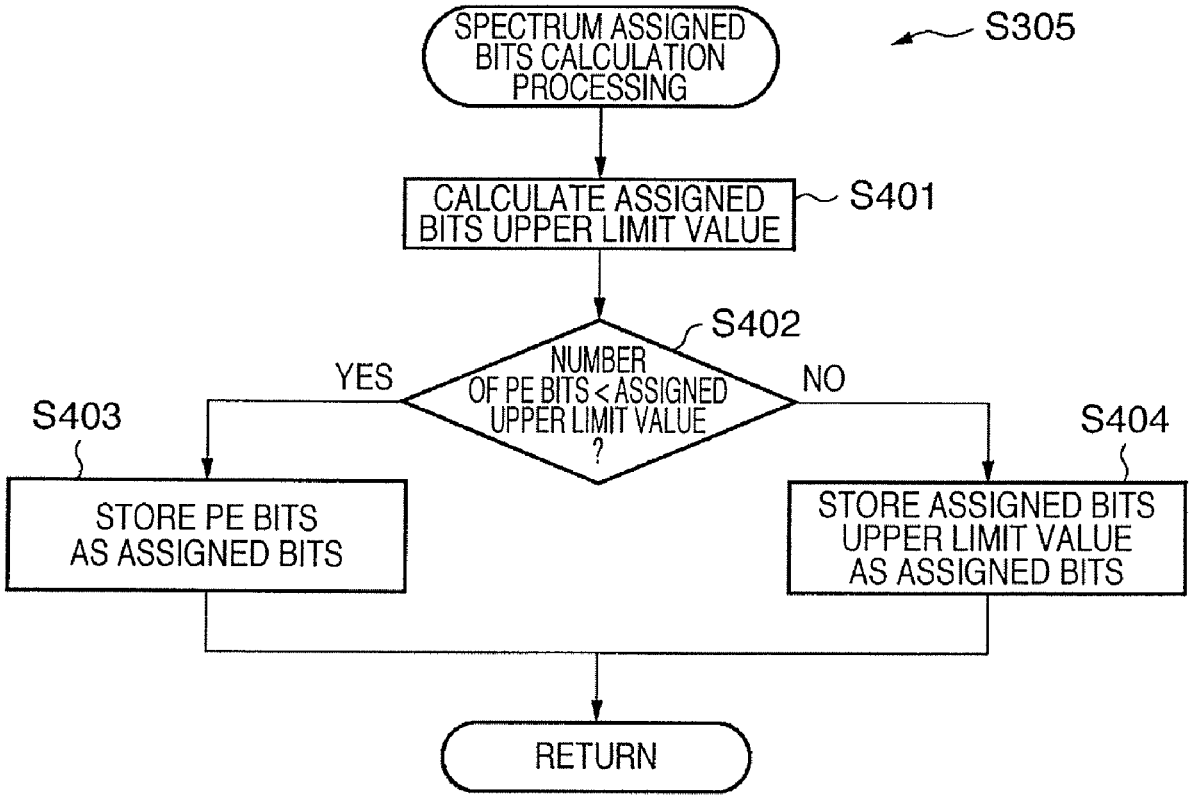
FIG. 12 is a flowchart of spectrum assigned bits calculation processing according to the fourth embodiment of the present invention.

FIG. 12 is a flowchart showing details of the spectrum assigned bits calculation processing in step S305 in this embodiment.

Step S401 is processing in which the CPU 100 calculates the upper limit value of the number of spectrum assigned bits by calculating the number of reserved bits that can be assigned to this frame in accordance with the reserved bit size and block type on the memory 101, and adding this value to the number of average assigned bits. In this embodiment, the number of reserved bits is determined as in the third embodiment in the following manner as:

10% of the reserved bit size when the block length is long, and

25% of the reserved bit size when the block length is short.

The CPU 100 adds the value obtained by the above sequence to the number of average assigned bits on the memory 101 to obtain the spectrum assigned bits upper limit value.

The CPU 100 stores the spectrum assigned bits upper limit value obtained by this calculation in the memory 101. Upon completion of the processing, the process advances to step S402.

Step S402 is processing in which the CPU 100 compares the number of PE bits and the spectrum assigned bits upper limit value on the memory 101. As a result of this comparison, if the number of PE bits is smaller than the spectrum assigned bits upper limit value, the process advances to step S403; otherwise, the process advances to step S404.

Step S403 is processing in which the CPU 100 stores the number of PE bits on the memory 101 as the number of spectrum assigned bits. That is, the CPU 100 copies the value of the number of PE bits to that of spectrum assigned bits. Upon completion of the processing, the control ends the spectrum assigned bits calculation processing and returns to the previous routine.

Step S404 is processing in which the CPU 100 stores the spectrum assigned bits upper limit value on the memory 101 as the number of spectrum assigned bits. That is, the CPU 100 copies the spectrum assigned bits upper limit value to the number of spectrum assigned bits. Upon completion of the processing, the control ends the spectrum assigned bits calculation processing and returns to the previous routine.

With this processing, since the upper limit value is set for the number of bits assigned by the PE bits, as described above, the bit reservoir can be prevented from collapsing due to depletion of reserved bits.

As described above, according to this embodiment, even when reserved bits reserved in the bit reservoir are to be assigned to a frame as needed in accordance with the characteristics of an input signal at the fixed bit rate, the quantized spectral total amount is accurately predicted before quantization. In this manner, the quantization step can be accurately determined before quantization, and quantization can be efficiently done while avoiding repetition of the spectrum quantization and bit calculations.

As described above, the audio signal encoding processing predicts the quantized spectral total amount based on the bit size assigned to a frame. In this way, the difference between the information amounts of all spectrum before and after quantization can be calculated, and the quantization step for all the spectrum can be approximately accurately predicted before spectrum quantization. Therefore, the quantization processing can be completed by executing the spectrum quantization processing by roughly once. As a result, the computational complexity required for the quantization processing can be greatly reduced compared to the prior art while maintaining encoding quality equivalent to that of the prior art.

Fifth Embodiment

Figure 13:
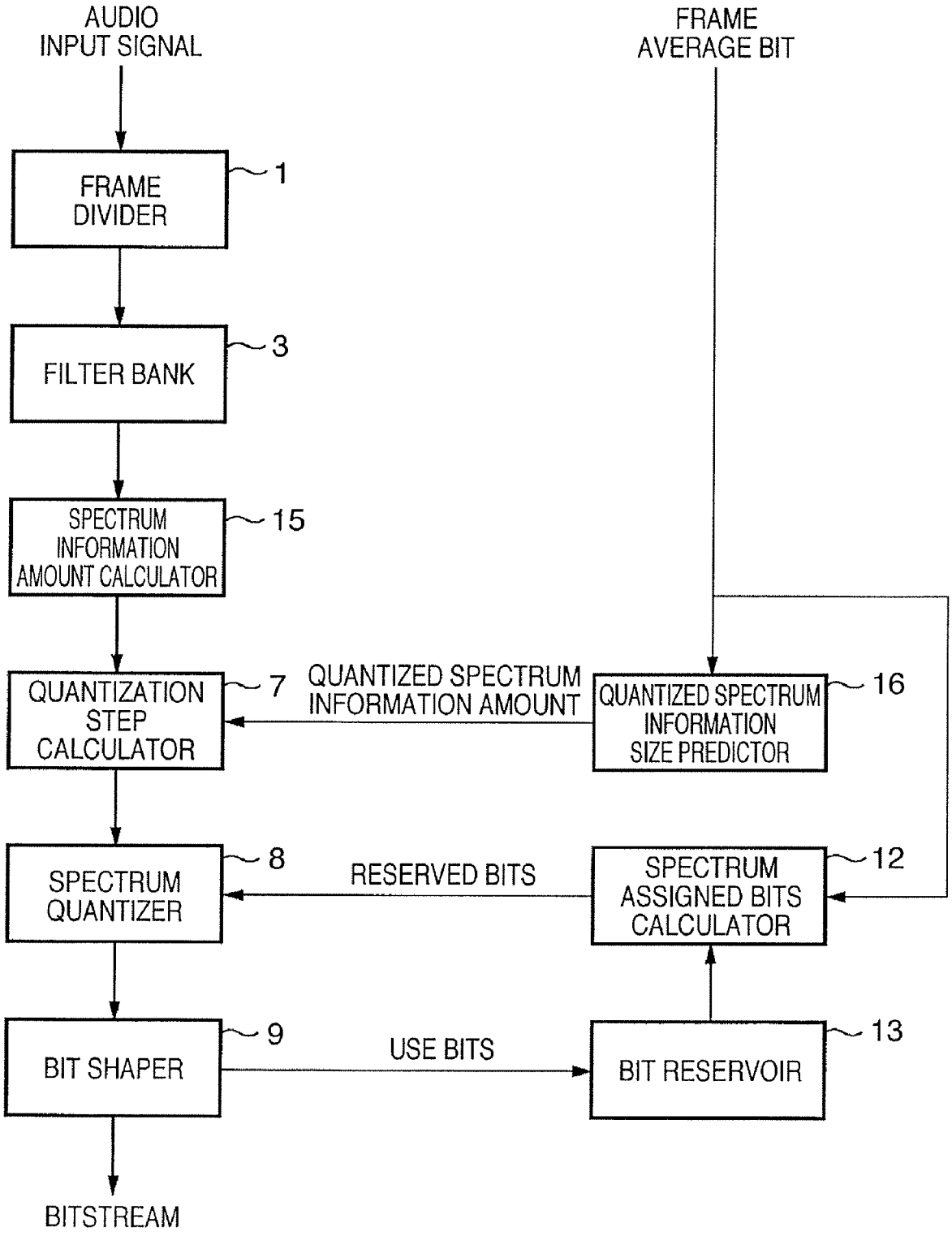
FIG. 13 is a block diagram showing an example of the arrangement of an audio signal encoding apparatus according to the fifth embodiment of the present invention.

An embodiment of the audio signal encoding apparatus with the arrangement from which the psychoacoustic processor 2 is excluded will be described hereinafter. FIG. 13 is a block diagram showing the arrangement of the audio signal encoding apparatus of this embodiment. Note that the same reference numerals denote the same building components as those in the above embodiments.

In the arrangement shown in FIG. 13, a frame divider 1 divides an audio input signal into frames as processing units. The input signal divided into frames is output to a filter bank 3. The filter bank 3 applies a window to time signals input from the frame divider 1, and performs a time-frequency transform to have a predetermined block length, thus converting the time signals into frequency spectrum.

A spectral information amount calculator 15 calculates a sum total of frequency spectrum output from the filter bank 3, and calculates an information amount of frequency spectrum before quantization based on the sum total. A quantization step calculator 7 calculates a quantization step by subtracting a quantized spectral information amount predicted by a quantized spectral information amount predictor 16 (to be described later) from the information amount of spectrum before quantization calculated by the spectral information amount calculator 15. A spectrum quantizer 8 quantizes respective frequency spectrum. A bit shaper 9 generates a bitstream by shaping scale factors and quantized spectrum to a predetermined format as needed, and outputs the generated bitstream. A bit reservoir 13 manages the number of reserved bits specified by each encoding standard.

A spectrum assigned bits calculator 12 calculates the number of bits to be assigned to quantized spectrum codes based on the reserved bit size notified from the bit reservoir 13 and a frame average bit size. The quantized spectral information amount predictor 16 makes a prediction calculation of a quantized spectral information amount based on the number of average bits assigned to each frame.

The audio signal encoding operation in the audio signal encoding apparatus with the above arrangement will be described below. Note that this embodiment will give the following explanation taking MPEG-2 AAC as an example of the encoding scheme for the sake of descriptive convenience. However, the present invention can be implemented by the same method using other encoding schemes to which a similar quantization scheme can be applied.

Prior to the processing, respective units are initialized. With this initialization, the quantization step and all scale factor values are set to be zero.

The frame divider 1 divides an audio input signal such as an audio PCM signal or the like into frames, which are sent to the filter bank 3. In case of an MPEG-2 AAC LC (Low-Complexity) profile, one frame is composed of 1024 samples of PCM signals, which are output.

The filter bank 3 transforms time signals for two frames including the current input signal for one frame output from the frame divider 1 and an input signal for the preceding frame received in the previous transform, i.e., those for 2048 samples into 1024 samples of frequency components. In this embodiment, the input signal of the preceding frame is held in a buffer in the filter bank 3. The filter bank 3 applies a window to have 2048 samples of the input signal for one block, and then executes an MDCT, thus outputting 1024 frequency spectrum.

The spectral information amount calculator 15 calculates a sum total of the frequency spectrum output from the filter bank 3, and calculates an information amount of the frequency spectrum before quantization based on this sum total. In case of MPEG-2 AAC, the information amount of all the spectrum before quantization can be calculated by:

$$\log_2 \sum_i |x_i|^{\frac{3}{4}} \tag{11}$$

where $x_i$ is a spectrum before quantization, and the range of i for which the sum total is to be calculated is one frame, i.e., $0 \leqq i \leqq 1023$. The base 2 logarithm is calculated for the sum total of spectrum.

The quantized spectral information amount predictor 16 predicts a quantized spectral information amount based on the average number of bits to be assigned to each frame. In this prediction, the predictor 16 calculates a quantized spectral total amount based on the frame average bits first. In this embodiment, this calculation is made using an approximate expression which is prepared based on a measurement result obtained by actually measuring the relationship between the frame bit size and quantized spectral total amount upon quantizing by a conventional quantizer. For example, let F(x) be this approximate expression, and average_bits be the frame average bit size. Then, the predicted quantized spectral total amount is calculated by:

$$\sum_i X_q \approx F(\text{average_bits}) \tag{12}$$

where $X_q$ is the quantized spectrum, and the range of i for which the sum total is calculated is for one frame, i.e., $0 \leqq i \leqq 1023$. In this embodiment, the frame average bit size is calculated in advance based on the bit rate, sampling rate, and number of input channels upon system initialization. Since this calculation is known to a person skilled in the art, a detailed description thereof will not be given. As the frame average bit size held on the system, the value calculated upon initialization is used without being changed during the encoding processing.

Next, the quantized spectral total amount is transformed into a quantized spectral information amount. In this embodiment, this calculation is attained by calculating the base 2 logarithm for the quantized spectral total amount calculated using equation (12). That is, the quantized spectral information amount is given by:

$$\log_2 \sum_i X_q \tag{13}$$

The quantization step calculator 7 subtracts the quantized spectral information amount output from the quantized spectral information amount predictor 16 from the information amount of spectrum before quantization output from the spectral information amount calculator 15. After that, the calculator 7 calculates a quantization step as a quantization coarseness for the entire frame by multiplying that difference by a coefficient obtained from the step width of the quantization coarseness.

More specifically, in case of MPEG-2 AAC, a predicted value of the quantization step is obtained using:

$$\text{global_gain} = Int\left[\frac{16}{3}\cdot\left[\log_2\sum_i |x_i|^{\frac{3}{4}} - \log_2\sum_i X_q\right]\right] \quad (14)$$

where $X_q$ is the quantized spectrum, $x_i$ is the spectrum before quantization, and global_gain is the global gain (quantization step). Also, the range of i for which the sum total is to be calculated is one frame, i.e., $0 \leqq i \leqq 1023$.

Note that the first term of the right-hand side in equation (14) is:

$$\log_2\sum_i |x_i|^{\frac{3}{4}} \quad (15)$$

This is the information amount of all the spectruml before quantization, and is the value calculated using equation (11) by the spectral information amount calculator 15. Also, the second term of the right-hand side is:

$$\log_2\sum_i X_q \quad (16)$$

This is the quantized spectral information amount, and is the value predicted using equation (13) by the quantized spectral information amount predictor 16.

Note that equation (14) can be obtained by modifying spectrum quantization equation (1) above as needed, and uniformly substituting zero into scale factor scalefac.

The bit reservoir 13 notifies the spectrum assigned bits calculator 12 of the current reserved bit size managed by itself. The spectrum assigned bits calculator 12 adds, e.g., 20% of the notified reserved bit size to the frame average bit size as the number of assigned bits, and notifies the spectrum quantizer 8 of the number of assigned bits.

The spectrum quantizer 8 quantizes the 1024 frequency spectrum according to the quantization step output from the quantization step calculator 7. For example, in case of MPEG-2 AAC, the quantizer 8 calculates quantized spectrum using equation (1), and counts the number of bits consumed by the entire frame.

When the number of use bits exceeds the number of assigned bits notified from the spectrum assigned bits calculator 12, the quantization step is incremented until the number of use bits becomes equal to or smaller than the number of spectrum assigned bits, and spectrum quantization is executed again. However, the calculation of the quantization step calculator 7 is accurate, and some bits of the reserved bit size are added to assigned bits in addition to the bit size upon making the prediction calculation of the quantization step. For this reason, in many cases, quantization is completed by making the quantized spectrum calculation and bit calculation only once.

A frame for which the use bit size becomes short when it undergoes spectrum quantization using the quantization step calculated by the quantization step calculator 7 is that which inevitably has an information amount larger than the average frame from the beginning. For this reason, some reserved bits are added to assigned bits, and the spectrum quantization processing is executed with reference to this value, thus automatically assigning more bits to such frame.

The bit shaper 9 shapes the scale factors for respective SFBs and quantized spectrum into a bitstream according to the predetermined format, and outputs the bitstream.

Finally, the bit shaper 9 notifies the bit reservoir 13 of the actually used bit size. The bit reservoir 13 calculates the actually used reserved bit size from the used bit size notified from the bit shaper 9 and the frame average bit size, and increases or decreases reserved bits as needed.

The aforementioned audio signal encoding apparatus of this embodiment does not perform any psychoacoustic analysis, the processing load of which is heavy. In addition, this apparatus predicts the quantized spectral information amount based on the bit size assigned to each frame, and calculates the difference between the information amounts of all the spectrum before and after quantization, thus approximately accurately predicting the quantization step before spectrum quantization. For this reason, since the number of repetition times for adjustment of the quantization step is reduced, the quantization processing can be completed quickly, and the computational complexity required for the encoding processing can be greatly reduced.

The audio signal encoding apparatus of this embodiment executes actual spectrum quantization after it predicts the quantization step based on the frame average bit size, and uniformly adds some bits of the reserved bit size. In this way, even when slight prediction errors occur, the quantization processing can be done by single processing. In addition, since reserved bits are automatically assigned to a frame which has a large information amount from the beginning, sound quality deterioration due to non-execution of psychoacoustic analysis can be minimized.

Sixth Embodiment

Note that the aforementioned fifth embodiment can be implemented by a software program which runs on a general-purpose computer such as a personal computer (PC) or the like as in the second embodiment.

Since the arrangement of the audio signal encoding apparatus of this embodiment is the same as that of the second embodiment, FIGS. 5 and 6 will be quoted.

Figure 17:
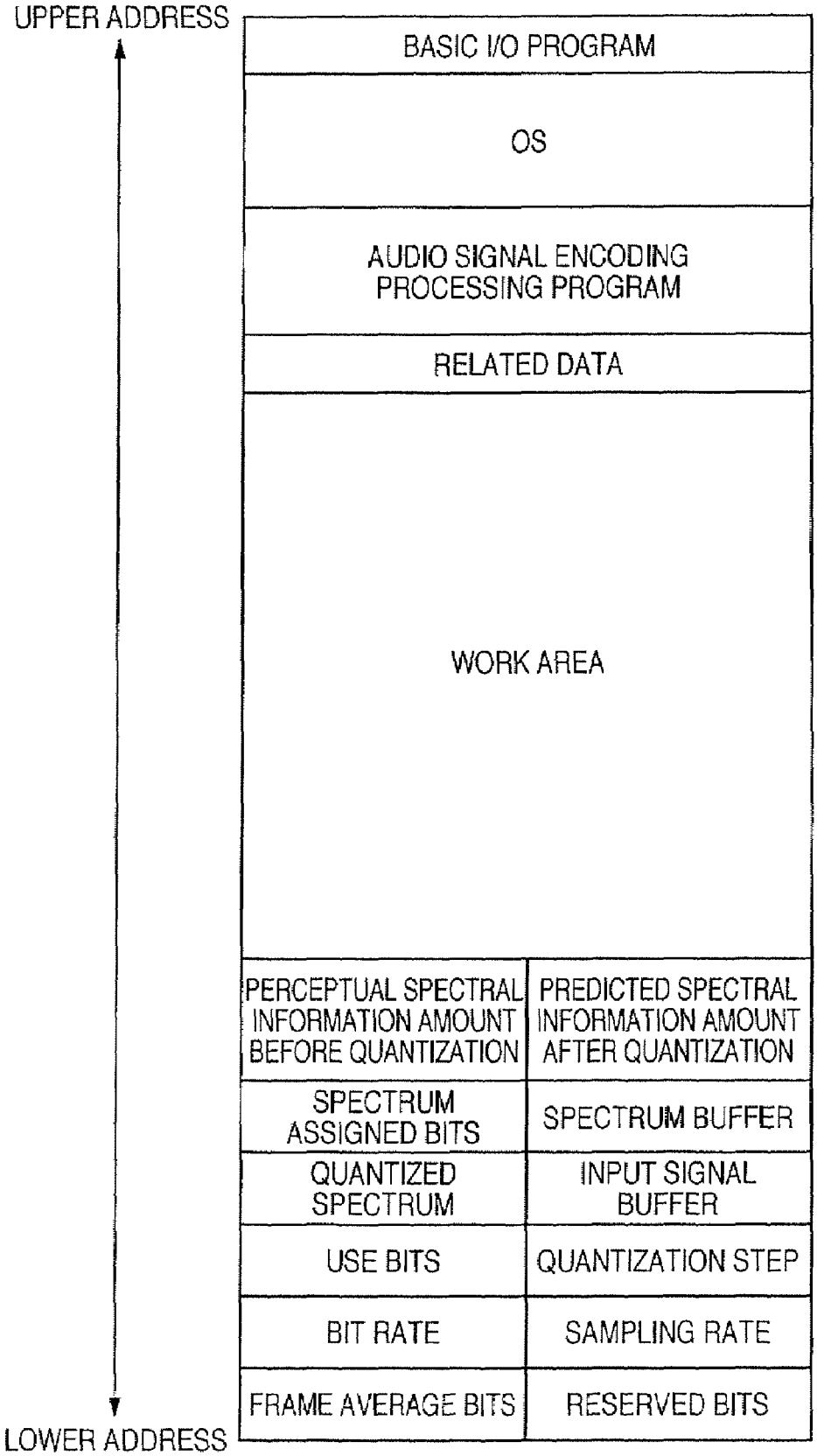
FIG. 17 shows an example of the memory map according to the sixth embodiment of the present invention.

FIG. 17 shows the memory map when an audio signal encoding processing program of this embodiment is loaded onto the memory 101 and is ready to run. As shown in FIG. 17, a work area of the memory 101 stores, e.g., a perceptual spectral information amount before quantization, a spectrum predicted information amount after quantization, the number of spectrum assigned bits, a spectrum buffer, quantized spectrum, and an input signal buffer. In addition, the work area also stores the number of use bits, a quantization step, a bit rate, a sampling rate, the number of average assigned bits, and a reserved bit size.

Figure 18:
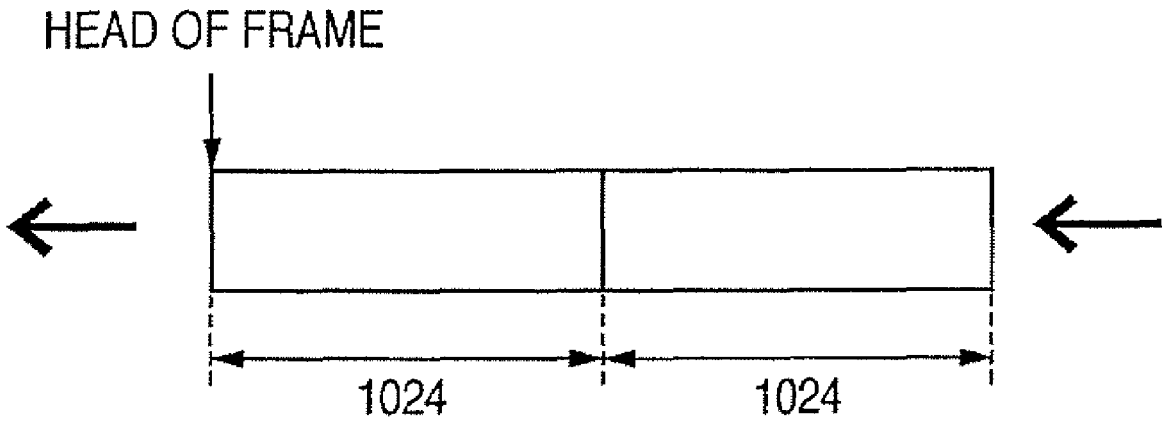
FIG. 18 shows an example of the configuration of an input signal buffer according to the sixth embodiment of the present invention.
Figure 19:
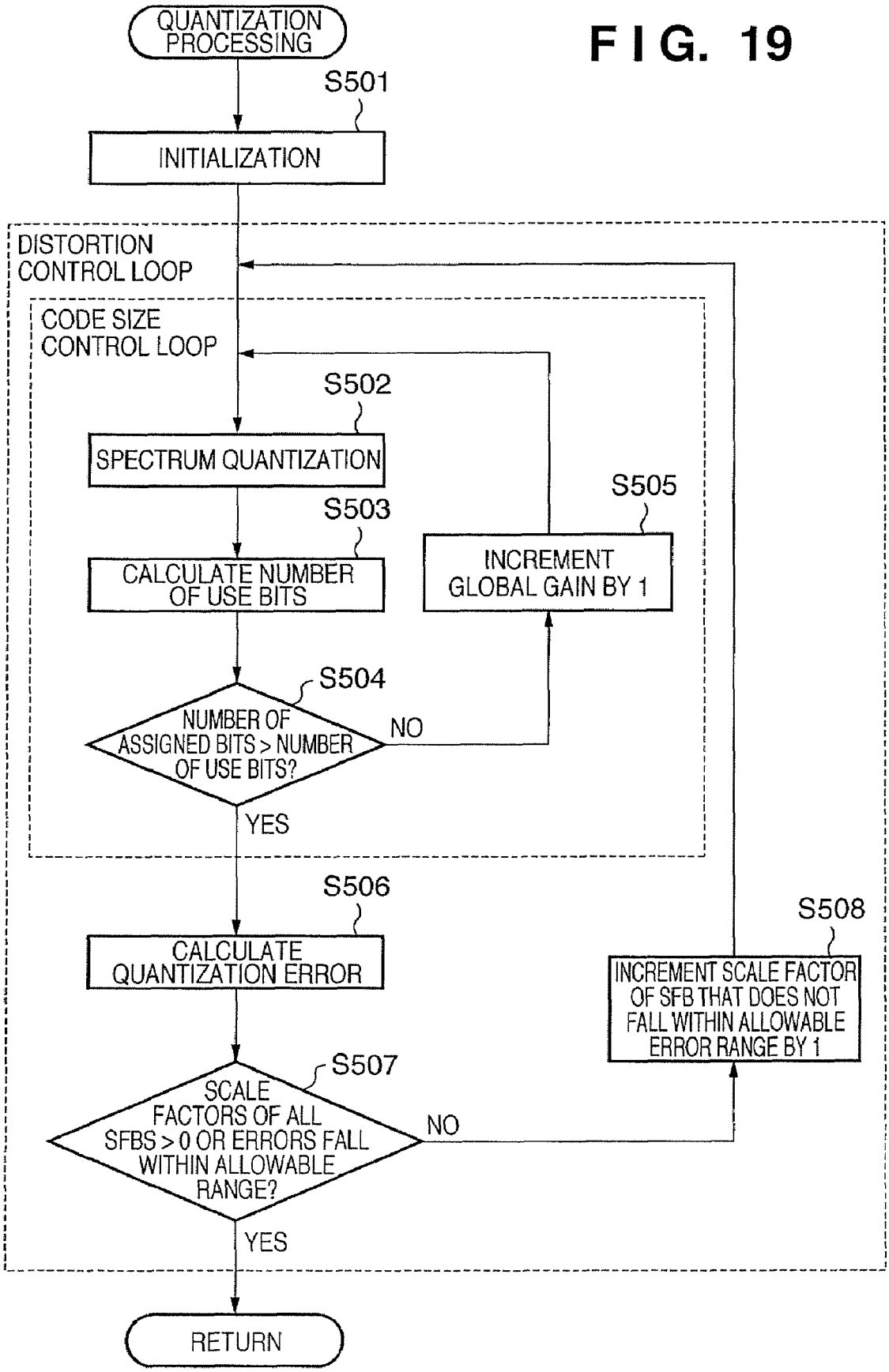
FIG. 19 is a flowchart of quantization processing according to the conventional ISO written standards.

FIG. 18 shows an example of the configuration of an input signal buffer in the audio signal encoding apparatus of this embodiment. In the configuration shown in FIG. 18, the buffer size is 1024×2 samples, and is divided by vertical lines for every 1024 samples for the sake of descriptive convenience. Input signals for one frame, i.e., 1024 samples, are input, and undergo batch processing from the left. The bold line arrow indicates the flow of input signals. Note that the configuration shown in FIG. 18 illustrates an input signal buffer for one channel, and similar buffers are prepared as many as the number of channels of input signals in this embodiment.

The audio signal encoding processing executed by the CPU 100 in this embodiment will be described below with reference to the flowcharts.

Figure 14:
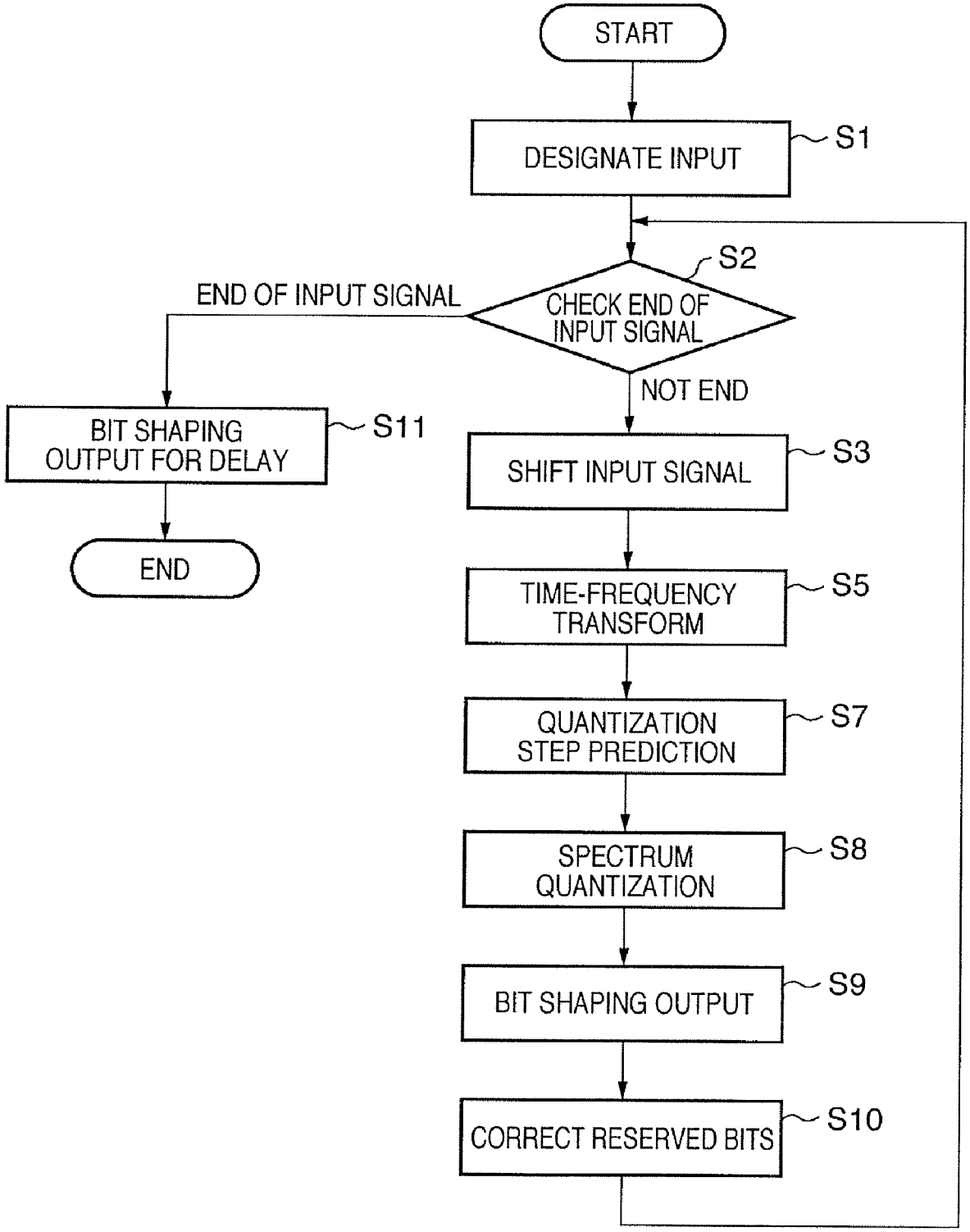
FIG. 14 is a flowchart of audio signal encoding processing according to the sixth embodiment of the present invention.

FIG. 14 is a flowchart of the audio signal encoding processing in this embodiment. The program corresponding to this flowchart is included in the audio signal encoding processing program, and is loaded onto the memory 101 and is executed by the CPU 100, as described above.

Step S1 is processing in which the CPU 100 allows the user to designate an input audio signal to be encoded using the terminal 103. In this embodiment, an audio signal to be encoded may be an audio PCM file stored in the external storage device 104 or may be a signal obtained by analog-to-digital converting a real-time audio signal captured by the microphone 106. Upon completion of this processing, the process advances to step S2.

Step S2 is processing in which the CPU 100 checks if the input audio signal to be encoded ends. If the input signal ends, the process advances to step S11. If the input signal does not end, the process advances to step S3.

Step S3 is input signal shift processing in which the CPU 100 shifts time signals for two frames, i.e. 2048 samples from the right to the left by one frame and loads new signals for one frame, i.e., 1024 samples on the right side in the input signal buffer shown in FIG. 18. This processing is done for all channels included in the input signal. Upon completion of the processing, the process advances to step S5.

In step S5, the CPU 100 applies a window to time signals for the current frame, i.e., signals for 2048 samples (two frames) stored in the input signal buffer in FIG. 18, and then executes a time-frequency transform. As a result, in case of MPEG-2 AAC, the CPU 100 obtains one set of spectrum decomposed into 1024 frequency components. Note that the block type of all blocks is set to have a long block length in this embodiment. The CPU 100 stores a total of calculated 1024 spectrum in a spectrum buffer assured in the work area on the memory 101. Upon completion of step S5, the process advances to step S7.

Step S7 is processing in which the CPU 100 calculates a quantization step based on the difference between the information amount of spectrum before quantization, and that of the quantized spectrum. Details of this processing will be described later with reference to FIG. 15. Upon completion of step S7, the process advances to step S8.

In step S8, the CPU calculates the number of use bits by quantizing the 1024 frequency spectrum according to the quantization step calculated in step S7. Only when the number of use bits exceeds the number of assigned bits stored in the work area on the memory 101, the CPU 100 increments the quantization step and executes re-quantization. Details of this processing will be described later with reference to FIG. 16. Upon completion of step S8, the process advances to step S9.

Step S9 is processing in which the CPU 100 shapes the quantized spectrum calculated in step S8 and scale factors according to the format specified by the encoding scheme, and outputs them as a bitstream. In this embodiment, the CPU 100 may store the bitstream output by this processing in the external storage device 104 or may output the bitstream to an external device connected to the communication network 108 via the communication interface 109. Upon completion of step S9, the process advances to step S10.

Step S10 is processing in which the CPU 100 corrects the number of reserved bits stored on the memory 101 from the bit size used in the bitstream output in step S9 and the frame average bit size. Upon completion of step S10, the process returns to step S2.

Step S11 is processing in which as quantized spectrum to be output still remain on the memory due to a delay caused by orthogonal transformation, and the like, the CPU 100 shapes them into a bitstream and outputs the bitstream. Upon completion of step S11, the audio signal encoding processing ends.

Figure 15:
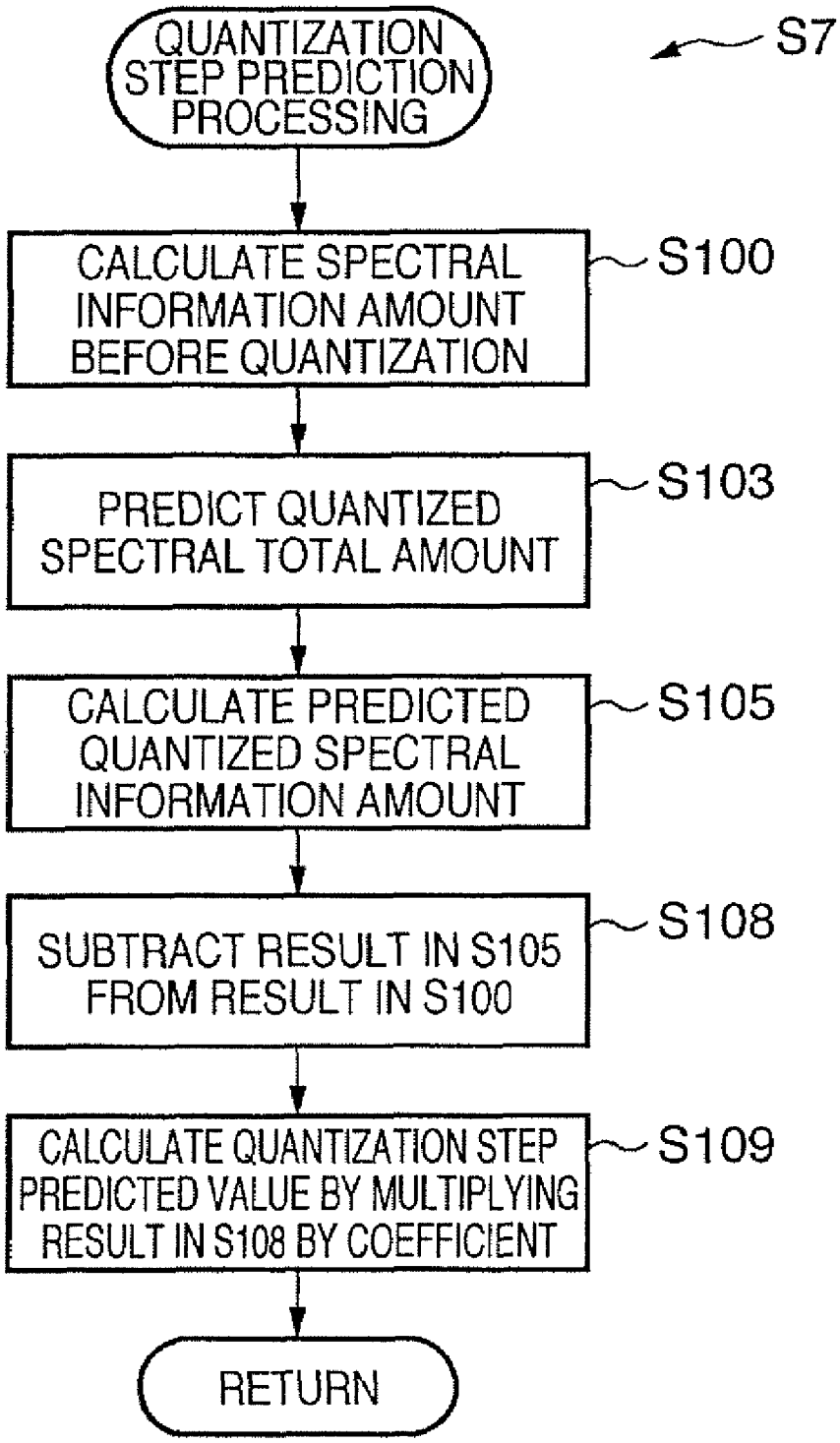
FIG. 15 is a flowchart of quantization step prediction processing according to the sixth embodiment of the present invention.

FIG. 15 is a flowchart showing details of the quantization step prediction processing in step S7 described above.

Step S100 is processing in which the CPU 100 calculates an information amount of spectrum before quantization. The CPU 100 calculates the spectral information amount before quantization by calculating a total size of respective spectrum components, and then calculating the logarithm of the total size. For example, in case of MPEG-2 AAC, the spectral information amount before quantization can be calculated by:

$$\log_2 \sum_i |x_i|^{\frac{3}{4}} \tag{17}$$

The CPU 100 saves the calculated spectral information amount before quantization in the work area on the memory 101. Upon completion of step S100, the process advances to step S103.

Step S103 is processing in which the CPU 100 makes a prediction calculation of the quantized spectral total amount using the number of frame average bits on the memory 101. The CPU 100 makes this prediction calculation using an approximate expression obtained by conducting experiments in advance. For example, let F(x) be this approximate expression, and average_bits be the number of frame average bits. Then, the quantized spectrum predicted total size can be calculated by:

$$\sum_i X_q \approx F(\text{average_bits}) \tag{18}$$

The CPU 100 stores the calculated quantized spectrum predicted total size in the work area on the memory 100. Upon completion of step S103, the process advances to step S105.

Step S105 is processing in which the CPU 100 calculates a quantized spectrum predicted information amount by calculating the logarithm of the quantized spectrum predicted total size calculated in step S103. For example, in case of MPEG-2 AAC, the CPU 100 can calculate the quantized spectrum predicted information amount by calculating:

$$\log_2 \sum_i X_q \tag{19}$$

The CPU 100 saves the quantized spectral information amount calculated by this processing in the work area on the memory 101. Upon completion of step S105, the process advances to step S108.

In step S108, the CPU 100 subtracts the quantized spectrum predicted information amount calculated in step S105 from the spectral information amount before quantization calculated in step S100. In step S109, the CPU 100 calculates a global gain, i.e., a predicted value of a quantization step by multiplying the difference in step S108 by a coefficient determined by the step width of the quantization coarseness. In case of MPEG-2 AAC, this predicted value is obtained by consequently calculating equation (5) as in the first embodiment.

$$\text{global_gain} = Int\left[\frac{16}{3}\cdot\left[\log_2\sum_i\left[|x_i|^{\frac{3}{4}}\cdot 2^{\frac{3}{16}\cdot scalefac}\right]-\log_2\sum_i X_q\right]\right] \quad (5)$$

The CPU 100 stores the calculated quantization step predicted value as the quantization step in the work area on the memory 101. In this way, the control ends the quantization step prediction processing, and returns to the previous routine.

Figure 16:
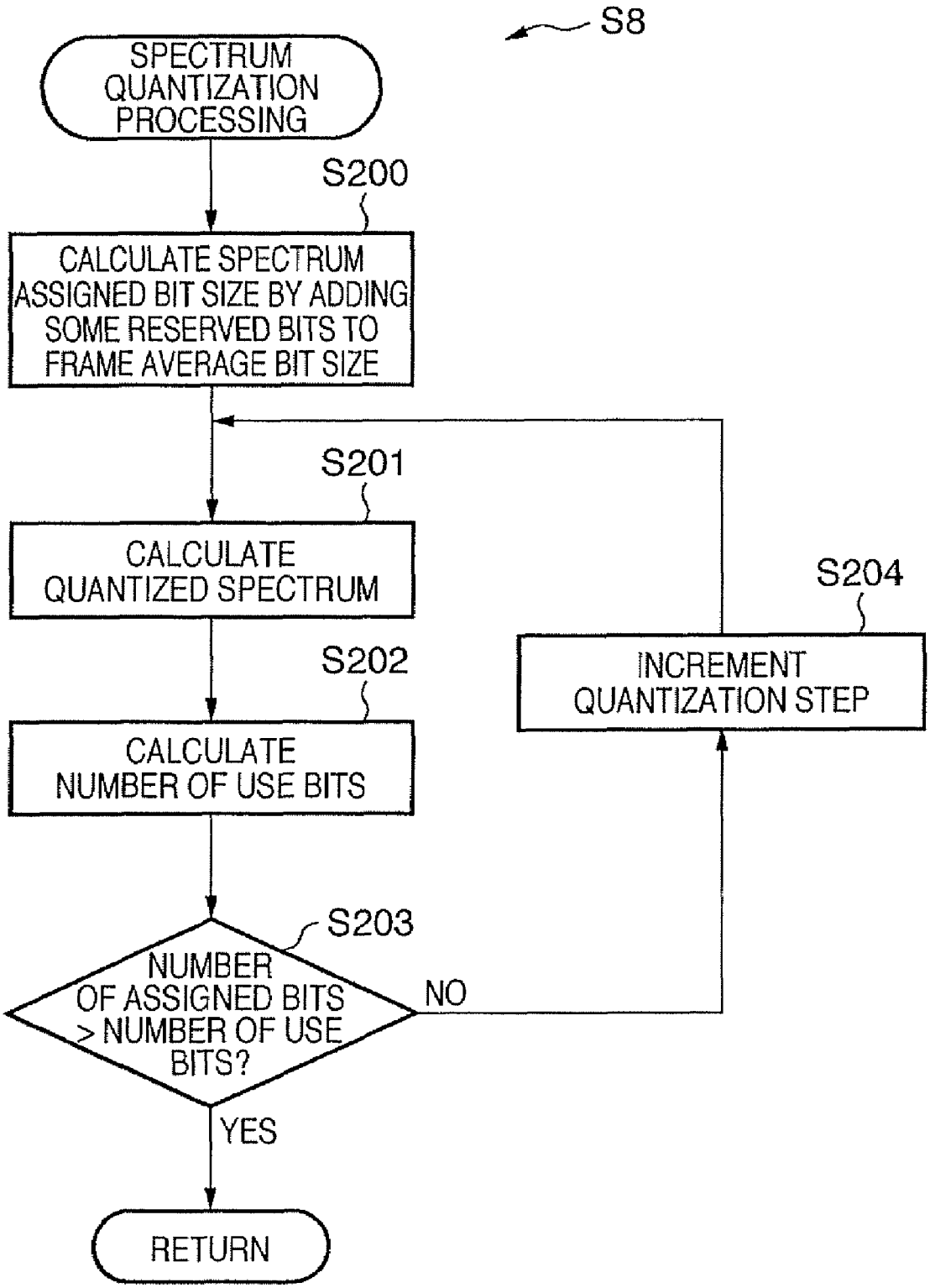
FIG. 16 is a flowchart of spectrum quantization processing according to the sixth embodiment of the present invention.

FIG. 16 is a flowchart showing details of the spectrum quantization processing in step S8 described above.

Step S200 is processing in which the CPU 100 calculates the number of spectrum assigned bits by adding some bits of the reserved bit size to the frame average bit size stored on the memory 101. For example, in this embodiment, the CPU 100 uniformly adds 20% of the reserved bit size to the frame average bit size to obtain the number of spectrum assigned bits. The CPU 100 stores the calculated number of spectrum assigned bits in the work area on the memory 101. Upon completion of step S200, the process advances to step S201.

Step S201 is processing in which the CPU 100 quantizes 1024 spectrum components stored in the spectrum buffer in accordance with the quantization step stored on the memory 101. In case of MPEG-2 AAC, the CPU 100 calculates the quantized spectrum according to equation (1) above. Upon completion of step S201, the process advances to step S202.

Step S202 is processing in which the CPU 100 calculates the number of bits used upon encoding all the quantized spectrum calculated in step S201. For example, in case of MPEG-2 AAC, since a plurality of quantized spectrum are combined, and are then Huffman-encoded, the CPU 100 searches Huffman code tables and calculates the total of the numbers of encoded bits in this processing. The CPU 100 stores the calculated number of use bits in the work area on the memory 101. Upon completion of step S202, the process advances to step S203.

Step S203 is processing in which the CPU 100 compares the number of spectrum assigned bits with the number of use bits on the memory 101. As a result of comparison, if the number of use bits is larger than the number of assigned bits, the process advances to step S204 to increment the quantization step stored in the memory 101 so as to reduce the code amount. After that, the process returns to step S201 to quantize the spectrum again. However, the aforementioned quantization step prediction processing (step S7) shown in FIG. 15 approximately accurately predicts the quantization step, and predicts the quantization step based on the frame average bit size. Also, since the code amount control is made with reference to the spectrum assigned bits obtained by adding some reserved bits to the frame average bits in step S203, step S204 is rarely executed in practice.

As a result of quantization using the predicted quantization step, even when the number of use bits exceeds the number of frame average bits, if it does not exceed the added reserved bit size, quantization is completed by single spectrum quantization. In addition, such frame is that which has a large information amount from the beginning, and many bits are consequently automatically assigned to the frame with the large information amount.

As a result of comparison in step S203, if the number of use bits is smaller than the number of assigned bits, the control ends the spectrum quantization processing and returns to the previous routine.

The aforementioned audio signal encoding processing of this embodiment omits any psychoacoustic analysis. Then, the information amount of the quantized spectrum is predicted based on the frame average bit size, and difference from the spectral information amount before quantization is calculated, thus approximately accurately predicting the quantization step before actual quantization. In this manner, since adjustment of the quantization step can be avoided as much as possible without any psychoacoustic arithmetic operations, the computational complexity required for the entire encoding processing can be greatly reduced.

The audio signal encoding apparatus of this embodiment executes actual spectrum quantization after it predicts the quantization step based on the frame average bit size, and uniformly adds some bits of reserved bit size. In this way, even when slight prediction errors occur, the quantization processing can be done by single processing. In addition, because reserved bits are automatically assigned to a frame which has a large information amount from the beginning, sound quality deterioration due to non-execution of psychoacoustic analysis can be minimized.

Other Embodiments

Various modifications of the present invention can be made without departing from its scope.

For example, in the above embodiments, no block switching is made. The present invention can be similarly applied to an apparatus which does not perform any auditory analysis, and relatively simply detects a transient state of input signal to perform block switching.

The present invention may be applied to either a system constituted by a plurality of devices, or an apparatus consisting of a single device.

Note that the present invention can be achieved by directly or remotely supplying a program that implements the functions of the aforementioned embodiments to a system or apparatus, and reading out and executing the supplied program code by a computer of that system or apparatus.

Therefore, the program code itself installed in that computer to implement the functional processing and functions of the present invention using the computer implements the present invention. That is, the computer program itself for implementing the functional processing and functions is one of the present invention.

In this case, the form of program is not particularly limited, and an object code, a program to be executed by an interpreter, script data to be supplied to an OS, and the like may be used as long as they have the program function.

A recording medium for supplying the program includes, for example, a flexible disk, hard disk, optical disk, magneto-optical disk, MO, CD-ROM, CD-R, CD-RW, and the like may be used. In addition, the recording medium includes a magnetic tape, nonvolatile memory card, ROM, DVD (DVD-ROM, DVD-R), and the like.

The program may be downloaded from a home page on the Internet using a browser of a client computer. That is, the computer program itself of the present invention or a compressed file including an automatic installation function may be downloaded from the home page to a recording medium such as a hard disk or the like. Also, the program code which forms the program of the present invention may be segmented into a plurality of files, which may be downloaded from different home pages. That is, a WWW server which makes a plurality of users download program files that implement the functions and processing of the present invention on a computer may often be a constituent element of the present invention.

Also, a storage medium such as a CD-ROM or the like, which stores the encrypted program of the present invention, may be delivered to the user. In this case, only the user who has cleared a predetermined condition may be allowed to download key information that decrypts the encrypted program from a home page via the Internet. Then, the encrypted program may be decrypted using that key information, and the decrypted program may be executed to install the program on a computer.

The functions of the aforementioned embodiments may be implemented by executing the readout program by the computer. Note that an OS or the like which runs on the computer may execute some or all of actual processing operations based on instructions of that program. In this case as well, the functions of the aforementioned embodiments can be implemented.

Furthermore, the program read out from the recording medium may be written in a memory equipped on an function expansion board or function expansion unit which is inserted in or connected to the computer. A CPU or the like equipped on the function expansion board or function expansion unit may execute some or all of actual processing operations based on instructions of that program. The functions of the aforementioned embodiments may be implemented in this manner.

CLAIM OF PRIORITY

This application claims the benefit of Japanese Patent Application No. 2004-335005, filed on Nov. 18, 2004, and Japanese Patent Application No. 2005-328945, filed on Nov. 14, 2005, which are hereby incorporated by reference herein in their entirety.

The invention claimed is:

1. An audio signal encoding apparatus comprising:

a frame dividing unit configured to divide an audio input signal into processing unit frames for respective channels;

a psychoacoustic arithmetic unit configured to analyze the audio input signal to determine a transform block length and to make an auditory masking calculation;

a filter bank unit configured to decompose a frame to be processed into blocks in accordance with the transform block length determined by said psychoacoustic arithmetic unit to transform time domain signals in the frame into one or more sets of frequency spectrum;

a scale factor calculation unit configured to divide the frequency spectrum output from said filter bank unit into a plurality of frequency bands, and calculate scale factors for weighting the spectrum in the respective frequency bands based on an arithmetic result of said psychoacoustic arithmetic unit;

a quantization step determination unit configured to determine a quantization step of the entire frame prior to spectrum quantization by subtracting an information amount of all quantized spectrum from a perceptual information amount of all the spectrum before quantization, which are weighted by the scale factors calculated by said scale factor calculation unit, and multiplying the difference by a coefficient obtained from a step width of a quantization coarseness;

a spectrum quantization unit configured to quantize the frequency spectrum using the scale factors and the quantization step; and a bit shaping unit configured to form and output a bitstream obtained by shaping quantized spectrum output from said spectrum quantization unit in accordance with a predetermined format, wherein said quantization step determination unit includes a quantized spectral information amount prediction unit configured to predict the information amount of all the quantized spectrum based on a bit size assigned to a frame to be encoded.

2. The apparatus according to claim 1 wherein an encoding scheme is MPEG-1 Audio Layer III.

3. The apparatus according to claim 1 wherein an encoding scheme is MPEG-2/4 AAC.

4. An audio signal encoding apparatus by comprising:

a frame dividing unit configured to divide an audio input signal into processing unit frames for respective channels;

a psychoacoustic arithmetic unit configured to analyze the audio input signal to determine a transform block length and to make an auditory masking calculation;

a filter bank unit configured to decompose a frame to be processed into blocks in accordance with the transform block length determined by said psychoacoustic arithmetic unit to transform time domain signals in the frame into one or more sets of frequency spectrum;

a scale factor calculation unit configured to divide the frequency spectrum output from said filter bank unit into a plurality of frequency bands, and calculate scale factors for weighting the spectrum in the respective frequency bands based on an arithmetic result of said psychoacoustic arithmetic unit;

a quantized spectral information amount prediction unit configured to predict an information amount of all quantized spectrum based on a bit size assigned to the frame to be encoded;

a quantization step determination unit configured to determine a quantization step of the entire frame prior to spectrum quantization by subtracting the information amount of all the quantized spectrum from a perceptual information amount of all the spectrum before quantization, which are weighted by the scale factors calculated by said scale factor calculation unit, and multiplying the difference by a coefficient obtained from a step width of a quantization coarseness;

a spectrum quantization unit configured to quantize the frequency spectrum using the scale factors and the quantization step; and a bit shaping unit configured to form and output a bitstream obtained by shaping quantized spectrum output from said spectrum quantization unit in accordance with a predetermined format, wherein when a predicted code amount of the input signal is less than the number of average frame assigned bits upon fixed bit rate encoding, said quantized spectral information amount prediction unit predicts the quantized spectral information amount based on perceptual entropies.

5. An audio signal encoding apparatus comprising:

a frame dividing unit configured to divide an audio input signal into processing unit frames for respective channels;

a psychoacoustic arithmetic unit configured to analyze the audio input signal to determine a transform block length and to make an auditory masking calculation;

a filter bank unit configured to decompose a frame to be processed into blocks in accordance with the transform block length determined by said psychoacoustic arithmetic unit to transform time domain signals in the frame into one or more sets of frequency spectrum;

a scale factor calculation unit configured to divide the frequency spectrum output from said filter bank unit into a plurality of frequency bands, and calculate scale factors for weighting the spectrum in the respective frequency bands based on an arithmetic result of said psychoacoustic arithmetic unit;

a quantized spectral information amount prediction unit configured to predict an information amount of all quantized spectrum based on a bit size assigned to the frame to be encoded;

a quantization step determination unit configured to determine a quantization step of the entire frame prior to spectrum quantization by subtracting the information amount of all the quantized spectrum from a perceptual information amount of all the spectrum before quantization, which are weighted by the scale factors calculated by said scale factor calculation unit, and multiplying the difference by a coefficient obtained from a step width of a quantization coarseness;

a spectrum quantization unit configured to quantize the frequency spectrum using the scale factors and the quantization step; and a bit shaping unit configured to form and output a bitstream obtained by shaping quantized spectrum output from said spectrum quantization unit in accordance with a predetermined format, wherein when a code amount used for the quantized spectrum exceeds an assigned code amount, said spectrum quantization unit adjusts the quantization step and requantizes the spectrum.

6. An audio signal encoding method comprising:

a frame dividing step of dividing an audio input signal into processing unit frames for respective channels;

a psychoacoustic arithmetic step of analyzing the audio input signal to determine a transform block length and to make an auditory masking calculation;

a filter bank processing step of decomposing a frame to be processed into blocks in accordance with the transform block length determined in the psychoacoustic arithmetic step to transform time domain signals in the frame into one or more sets of frequency spectrum;

a scale factor calculation step of dividing the frequency spectrum obtained in the filter bank processing step into a plurality of frequency bands, and calculating scale factors for weighting the spectrum in the respective frequency bands based on an arithmetic result in the psychoacoustic arithmetic step;

a quantization step determination step of determining a quantization step of the entire frame prior to spectrum quantization by subtracting an information amount of all quantized spectrum from a perceptual information amount of all the spectrum before quantization, which are weighted by the scale factors calculated in the scale factor calculation step, and multiplying the difference by a coefficient obtained from a step width of a quantization coarseness;

a spectrum quantization step of quantizing the frequency spectrum using the scale factors and the quantization step; and a bit shaping step of forming and outputting a bitstream obtained by shaping quantized spectrum obtained in the spectrum quantization step in accordance with a predetermined format, wherein the quantization step determination step includes a quantized spectral information amount prediction step of predicting the information amount of all the quantized spectrum based on a bit size assigned to a frame to be encoded.

7. A program stored on a computer-readable medium for making a computer execute an audio signal encoding method according to claim 6.

8. A computer-readable storage medium storing a program according to claim 7.

9. An audio signal encoding method comprising:

a frame dividing step of dividing an audio input signal into processing unit frames for respective channels;

a psychoacoustic arithmetic step of analyzing the audio input signal to determine a transform block length and to make an auditory masking calculation;

a filter bank processing step of decomposing a frame to be processed into blocks in accordance with the transform block length determined in the psychoacoustic arithmetic step to transform time domain signals in the frame into one or more sets of frequency spectrum;

a scale factor calculation step of dividing the frequency spectrum obtained in the filter bank processing step into a plurality of frequency bands, and calculating scale factors for weighting the spectrum in the respective frequency bands based on an arithmetic result in the psychoacoustic arithmetic step;

a quantized spectral information amount prediction step of predicting an information amount of all quantized spectrum based on a bit size assigned to a frame to be encoded;

a quantization step determination step of determining a quantization step of the entire frame prior to spectrum quantization by subtracting an information amount of all quantized spectrum from a perceptual information amount of all the spectrum before quantization, which are weighted by the scale factors calculated in the scale factor calculation step, and multiplying the difference by a coefficient obtained from a step width of a quantization coarseness;

a spectrum quantization step of quantizing the frequency spectrum using the scale factors and the quantization step; and a bit shaping step of forming and outputting a bitstream obtained by shaping quantized spectrum obtained in the spectrum quantization step in accordance with a predetermined format, wherein in the quantized spectral information amount prediction step, when a predicted code amount of the input signal is less than the number of average frame assigned bits upon fixed bit rate encoding, the quantized spectral information amount is predicted based on perceptual entropies.

10. An audio signal encoding method comprising:

a frame dividing step of dividing an audio input signal into processing unit frames for respective channels;

a psychoacoustic arithmetic step of analyzing the audio input signal to determine a transform block length and to make an auditory masking calculation;

a filter bank processing step of decomposing a frame to be processed into blocks in accordance with the transform block length determined in the psychoacoustic arithmetic step to transform time domain signals in the frame into one or more sets of frequency spectrum;

a scale factor calculation step of dividing the frequency spectrum obtained in the filter bank processing step into a plurality of frequency bands, and calculating scale factors for weighting the spectrum in the respective frequency bands based on an arithmetic result in the psychoacoustic arithmetic step;

a quantized spectral information amount prediction step of predicting an information amount of all quantized spectrum based on a bit size assigned to a frame to be encoded;

a quantization step determination step of determining a quantization step of the entire frame prior to spectrum quantization by subtracting an information amount of all quantized spectrum from a perceptual information amount of all the spectrum before quantization, which are weighted by the scale factors calculated in the scale factor calculation step, and multiplying the difference by a coefficient obtained from a step width of a quantization coarseness;

a spectrum quantization step of quantizing the frequency spectrum using the scale factors and the quantization step; and a bit shaping step of forming and outputting a bitstream obtained by shaping quantized spectrum obtained in the spectrum quantization step in accordance with a predetermined format, wherein in the spectrum quantization step, when a code amount used for the quantized spectrum exceeds an assigned code amount, the quantization step is adjusted and the spectrum are re-quantized.

11. An audio signal encoding apparatus comprising:

a frame dividing unit configured to divide an audio input signal into processing unit frames for respective channels;

a filter bank unit configured to execute processing for transforming time domain signals for two successive frames obtained from said frame dividing unit into frequency spectrum while shifting frame by frame;

a spectral information amount calculation unit configured to calculate an information amount of the frequency spectrum output from said filter bank unit as a spectral information amount before quantization;

a quantized spectral information amount prediction unit configured to predict a quantized spectral information amount based on a frame average bit size calculated from a bit rate and a sampling rate;

a quantization step determination unit configured to determine a quantization step for the entire frame prior to spectrum quantization by subtracting the quantized spectral information amount predicted by said quantized spectral information amount prediction unit from the spectral information amount before quantization calculated by said spectral information amount calculation unit, and multiplying the difference by a coefficient obtained from a step width of a quantization coarseness;

a spectrum quantization unit configured to quantize the frequency spectrum using the quantization step determined by said quantization step determination unit;

a bit reservoir configured to manage a reserved bit size complying with an encoding standard to match the standard;

a bit shaping unit configured to generate a bitstream by shaping the frequency spectrum quantized by said spectrum quantization unit in accordance with a predetermined format; and a spectrum assigned bits calculation unit configured to calculate a spectrum assigned bit size by partially adding the reserved bit size reserved in said bit reservoir to the frame average bit size, wherein said spectrum quantization unit performs code amount control based on the spectrum assigned bit size calculated by said spectrum assigned bits calculation unit.

12. The apparatus according to claim 11, wherein an encoding scheme is MPEG-1 Audio Layer III.

13. The apparatus according to claim 11, wherein an encoding scheme is MPEG-2/4 AAC.

14. An audio signal encoding method comprising:

a frame dividing step of dividing an audio input signal into processing unit frames for respective channels;

a time-frequency transform step of executing processing for transforming time domain signals for two successive frames obtained in the frame dividing step into frequency spectrum while shifting frame by frame;

a spectral information amount calculation step of calculating an information amount of the frequency spectrum obtained in the time-frequency transform step as a spectral information amount before quantization;

a quantized spectral information amount prediction step of predicting a quantized spectral information amount based on a frame average bit size calculated from a bit rate and a sampling rate;

a quantization step determination step of determining a quantization step for the entire frame prior to spectrum quantization by subtracting the quantized spectral information amount predicted in the quantized spectral information amount prediction step from the spectral information amount before quantization calculated in the spectral information amount calculation step, and multiplying the difference by a coefficient obtained from a step width of a quantization coarseness;

a spectrum quantization step of quantizing the frequency spectrum using the quantization step determined in the quantization step determination step;

a bit shaping step of generating a bitstream by shaping the frequency spectrum quantized in the spectrum quantization step in accordance with a predetermined format; and a spectrum assigned bits calculation step of calculating a spectrum assigned bit size by adding some of a reserved bit size reserved in a bit reservoir, which manages the reserved bit size complying with an encoding standard to match the standard, to the frame average bit size, wherein in the spectrum quantization step, code amount control is performed based on the spectrum assigned bit size calculated in the spectrum assigned bits calculation step.

15. A program stored on a computer-readable medium for making a computer execute an audio signal encoding method according to claim 14.

16. A computer-readable storage medium storing a program according to claim 15.

* * * * *